United States Patent [19]

Lyons

[11] 4,018,306

[45] Apr. 19, 1977

[54] EMERGENCY BUILDING ACCESS APPARATUS

[76] Inventor: Merlyn E. Lyons, 44-022 Aina Moi Place, Kaneohe, Hawaii 96744

[22] Filed: Mar. 3, 1975

[21] Appl. No.: 554,462

Related U.S. Application Data

[63] Continuation-in-part of Ser. No. 469,622, May 13, 1974, abandoned.

[52] U.S. Cl. ..... 187/6; 182/37; 182/142; 187/1 R; 187/7; 187/19; 187/29 R; 187/95

[51] Int. Cl.[2] ..... B66B 9/00

[58] Field of Search ..... 187/1 R, 2, 6, 7, 8, 187/12, 17, 19, 20, 27, 29, 95; 182/141, 142, 143, 144, 148, 37

[56] References Cited

UNITED STATES PATENTS

| | | | |
|---|---|---|---|
| 452,280 | 5/1891 | Nichols | 187/6 |
| 468,253 | 2/1892 | Neuburger | 187/29 G |
| 665,707 | 1/1901 | Tromanhauser | 182/142 X |
| 708,838 | 9/1902 | Sferlozza | 187/6 |
| 738,705 | 9/1903 | Stevenson et al. | 182/142 X |
| 920,630 | 5/1909 | Ocumpaugh | 187/19 |
| 1,069,088 | 7/1913 | Taylor | 187/1 R X |
| 1,470,292 | 10/1923 | Scheunert | 187/1 R |
| 1,716,268 | 6/1929 | Gosciewski | 182/148 X |
| 2,385,276 | 9/1945 | Hart et al. | 187/95 |
| 2,647,675 | 8/1953 | Bernett | 187/6 |
| 3,207,263 | 9/1965 | Cull | 187/2 |
| 3,347,339 | 10/1967 | Coole | 182/142 X |
| 3,498,414 | 3/1970 | White | 187/2 X |
| 3,519,101 | 7/1970 | Sieffert | 187/2 |
| 3,610,371 | 10/1971 | Abbott | 187/29 R |

FOREIGN PATENTS OR APPLICATIONS

| | | | |
|---|---|---|---|
| 143,985 | 10/1951 | Australia | 187/95 |
| 733,196 | 7/1956 | United Kingdom | 187/8 |

*Primary Examiner*—Evon C. Blunk
*Assistant Examiner*—James L. Rowland
*Attorney, Agent, or Firm*—William B. Walter

[57] ABSTRACT

An emergency building access apparatus permitting ready access to a multi-story building on fire and rapid evacuation of occupants from a choice of multiple of emergency exits on each floor by a safe and dependable means is a multiple of vertical railroads attached to outside walls of the building each coupled, for the emergency, to its mobile unit having a railcar, its own power source, a drive mechanism, and controls.

15 Claims, 36 Drawing Figures

EMERGENCY BUILDING ACCESS APPARATUS

REFERENCE

This is a continuation-in-part of application Ser. No. 469,622, filed May 13, 1974, now abandoned.

BACKGROUND OF THE INVENTION

Fires in even the most modern and recently built public multi-story buildings and especially high-rises continually prove the extreme hazard to life in such structures.

In excerpts from the "Fire Journal" and other sources the National Fire Protection Association in Boston, Mass. has documented in a recent booklet entitled "High Rise Building Fires and Fire Safety", many such fires claiming hundreds of lives. On pages 161 through 164 of the March 1973 issue of Reader's Digest an article entitled "How Fireproof Are the New Skyscrapers" as condensed from an article in the Pittsburgh Press by Warren R. Young again indicates the extreme hazard potential of the multi-story building and the need for improvements in the art to safeguard the lives of the occupants. The fire need not be high in a building to cause death as evidenced by the Osaka cabaret fire (see Fire Journal for March 1973) where 118 died and 69 were injured by a fire originating on the third floor of a seven story building.

The case of the high-rise buildings is particularly bad as existing fire fighting equipment and ladders will not reach more than the lower floors of a building and access is only by interior stairs and elevator shafts. In the Sao Paulo, Brazil fire of Feb. 1, 1974 the fire truck ladder could reach to the 11th floor only in a 22 story building where 176 died. Rapid and safe evacuation of people of all ages and states of health down such a tall ladder is at best questionable.

Elevators inside a building are often found to be inadequate as power and central air conditioning systems in the building are vulnerable to fire and smoke. Often the elevator descends to the floor on fire and stops at that point with the occupants unable to move it in either direction.

Stairways and elevator shafts become air ducts for ascending smoke and heat and thus are not dependable as a means for building occupants to either ascend or descend the building. Tragic, frantic attempts are made to flee the fire by improvised ropes and by jumping to death.

Fire fighters as well find it difficult to get to the fire point safely and quickly by elevator or stairways. Modern furnishings contain much plastic which is the source of great volumes of killing smoke in the building.

In the present stage of the art means to evacuate the occupants of a multi-story building on fire consist of the following:

1. outside steel frame fire escape stairways,
2. emergency staircases built into the building,
3. passenger and service elevators in elevator shafts,
4. passenger elevators installed on the outside wall,
5. construction elevators installed temporarily alongside buildings on their own towers, and
6. construction elevators having temporary or permanent rails attached to the outside of a building. See Davis patent U.S. Pat. No. 3,763,964.

Inside staricases and elevator shafts have been found hazardous because they often act as chimneys filled with killing smoke. Staircases of any type are inadequate for evacuating unaided aged and crippled particularly on high rises but certainly on hospitals. External staircases while usually free of smoke, are expensive to maintain, unsightly, and often a ready means to obtain access to a building by those with criminal intent.

While the external elevator should be safer than those in elevator shafts because of more freedom from smoke, the controls in the halls of each floor and dependance upon the building power supply limit their dependability. In addition, the expense involved in providing such elevators in serviceable condition on each wall so as to provide access on a safe wall or walls could easily add a great expense to the building.

Many hours or even several days are required to install the conventional construction elevator therefore eliminating its usefulness in an emergency. While the Davis elevator, U.S. Pat. No. 3,763,964, sugggests an emergency device, it has fallen short of a complete apparatus needed to accomplish the task.

Thus the need for a dependable yet reasonably economical apparatus to evacuate the occupants of a multi-story building has been apparent and yet not met in the prior art. This is especially true of the high rise where even the use of helicopters has been suggested overlooking the possible difficulty of the building occupants to get to the helicopter pad and the hazard of landing a helicopter on a building on fire.

BRIEF SUMMARY OF THE INVENTION

It is the basic object of the invention to provide a dependable and economically sound means to safely evacuate the occupants of a building rapidly from a variety of exits on each floor and at the same time provide access at those exits for firemen to combat the fire and aid building occupants.

Another basic object of the invention is to provide an emergency escape device which is dependent upon the building structurally only and independent of the building for power and mechanical drives.

This invention is a combination of two separate units which when coupled together quickly provide a temporary means to rapidly transport people up and down the side of a building with access to the building at each floor. The two separate units are (1) a vertical railroad permanently attached to the outside wall of the building and (2) a mobile unit providing a railcar for carrying people, and power, mechanical drives, and controls to move that railcar up and down the vertical railroad. The vertical railroad provides the essentials for guiding and supporting the railcar and access to the building at each floor and because it is mostly structural holds down the capital and maintenance cost to be added at each installation on the building. The mobile units combine those elements which can be separate and kept in well maintained readiness in a central area, preferably for a group of buildings equipped with vertical railroads.

BRIEF DESCRIPTION OF THE DRAWINGS

In the drawings

A version of the apparatus having a climbing hoist is shown in block diagram in FIG. 2, in the schematics of FIGS. 3, 4 and 5, and in greater detail in FIGS. 6, 7, 8, 9, and 10. Of these details.

Figure 11:
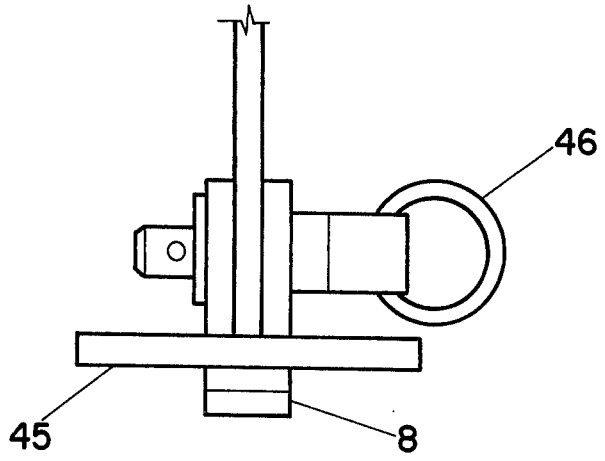
Figure 12:
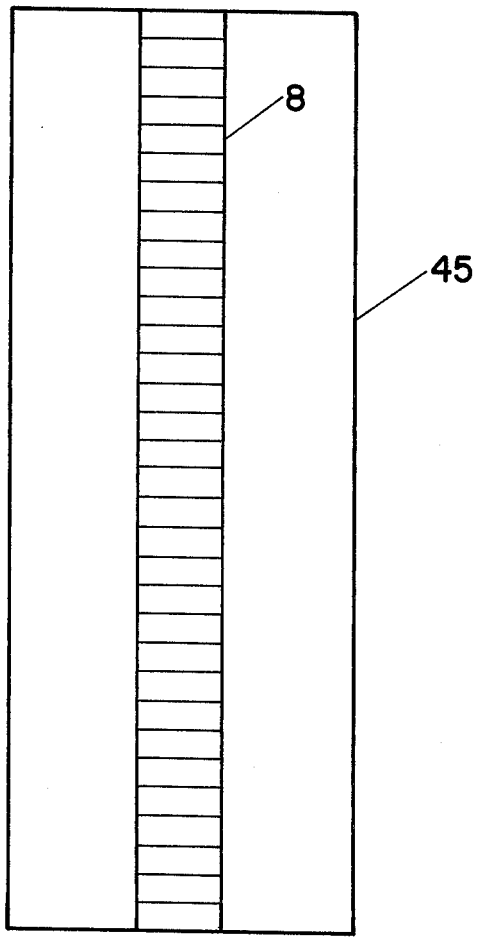
Figure 13:
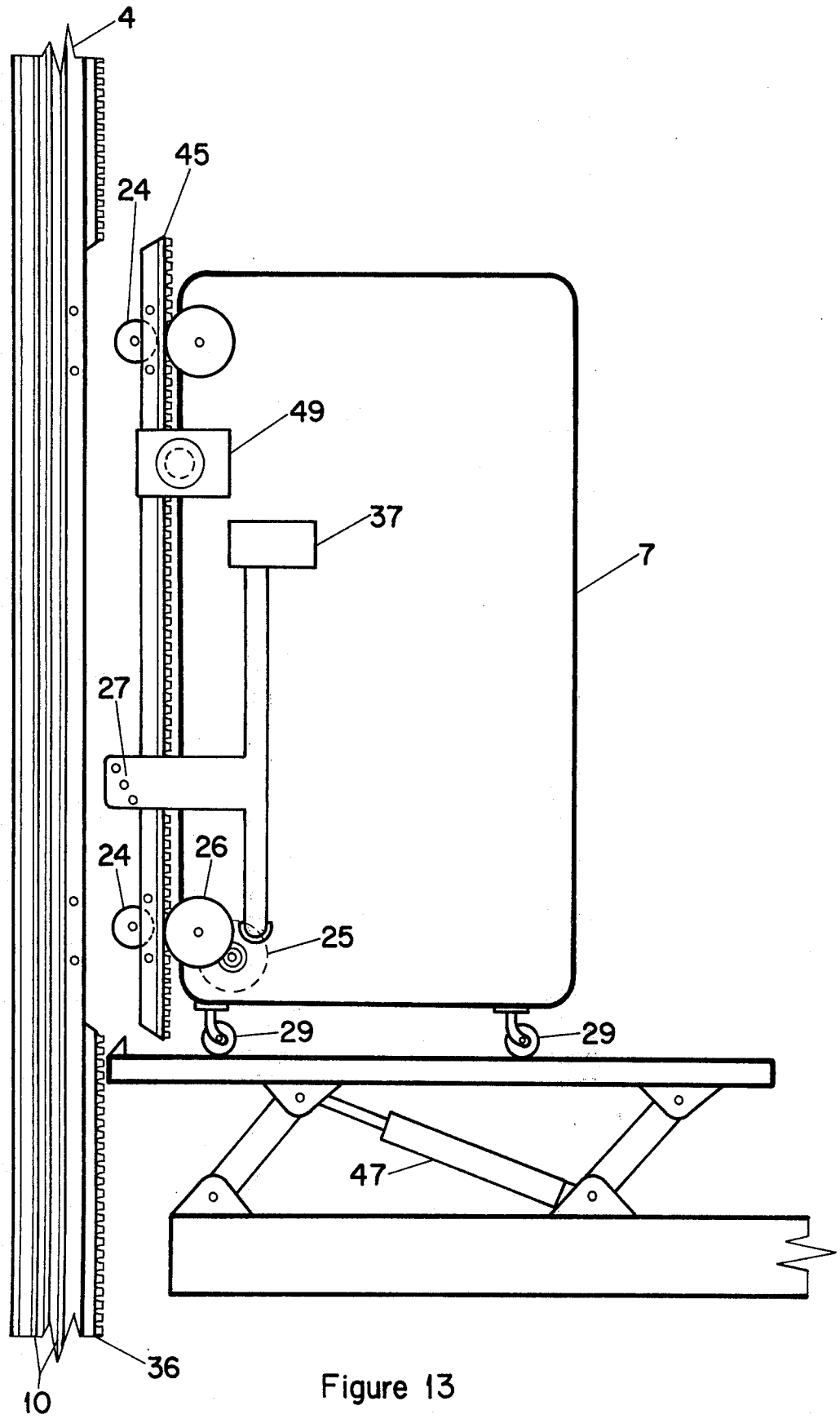

Another method of coupling railcar and/or hoist to the vertical rails using removable rail flanges is shown in FIGS. 11, 12, and 13.

Figure 14:
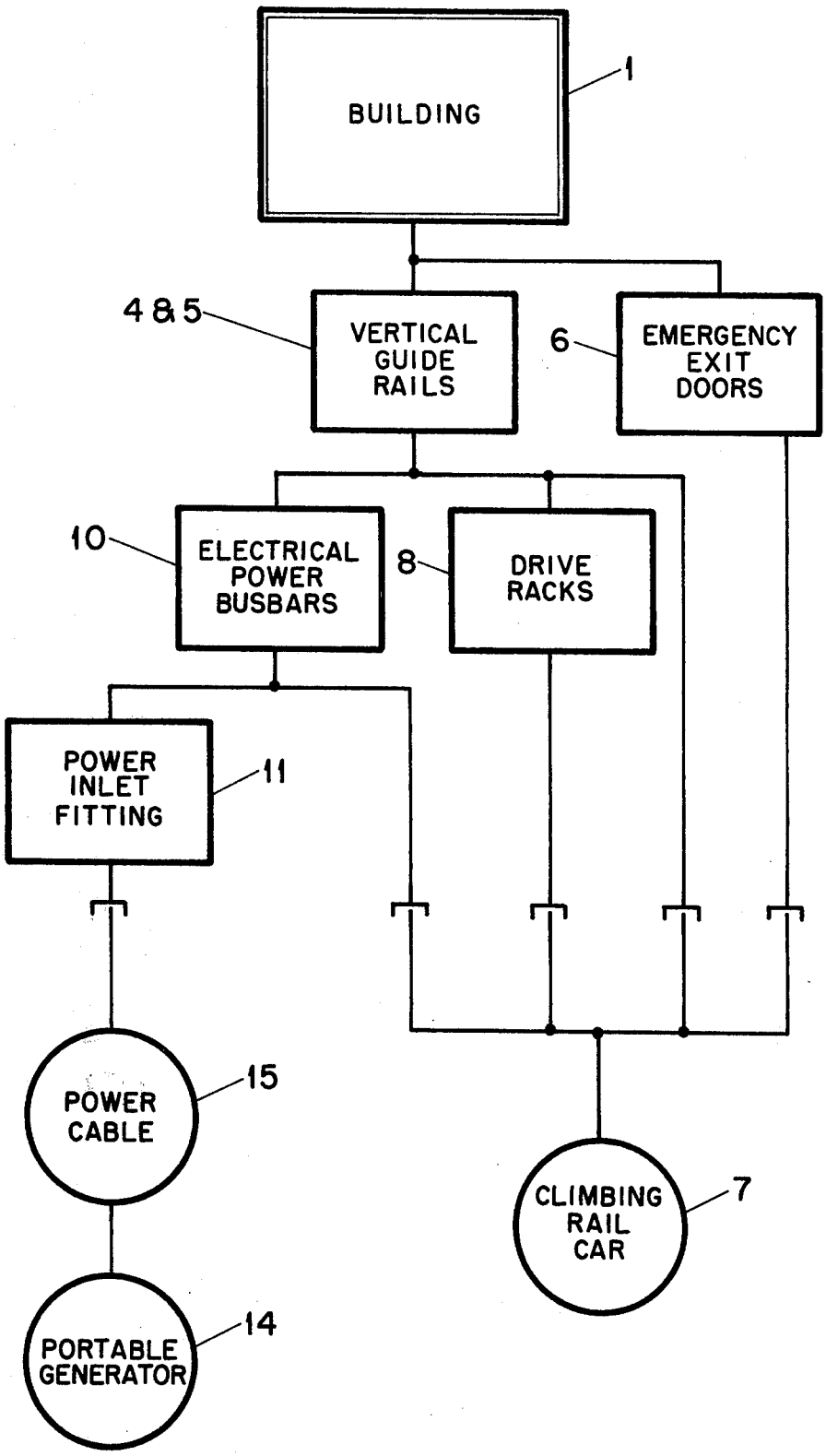
Figure 15:
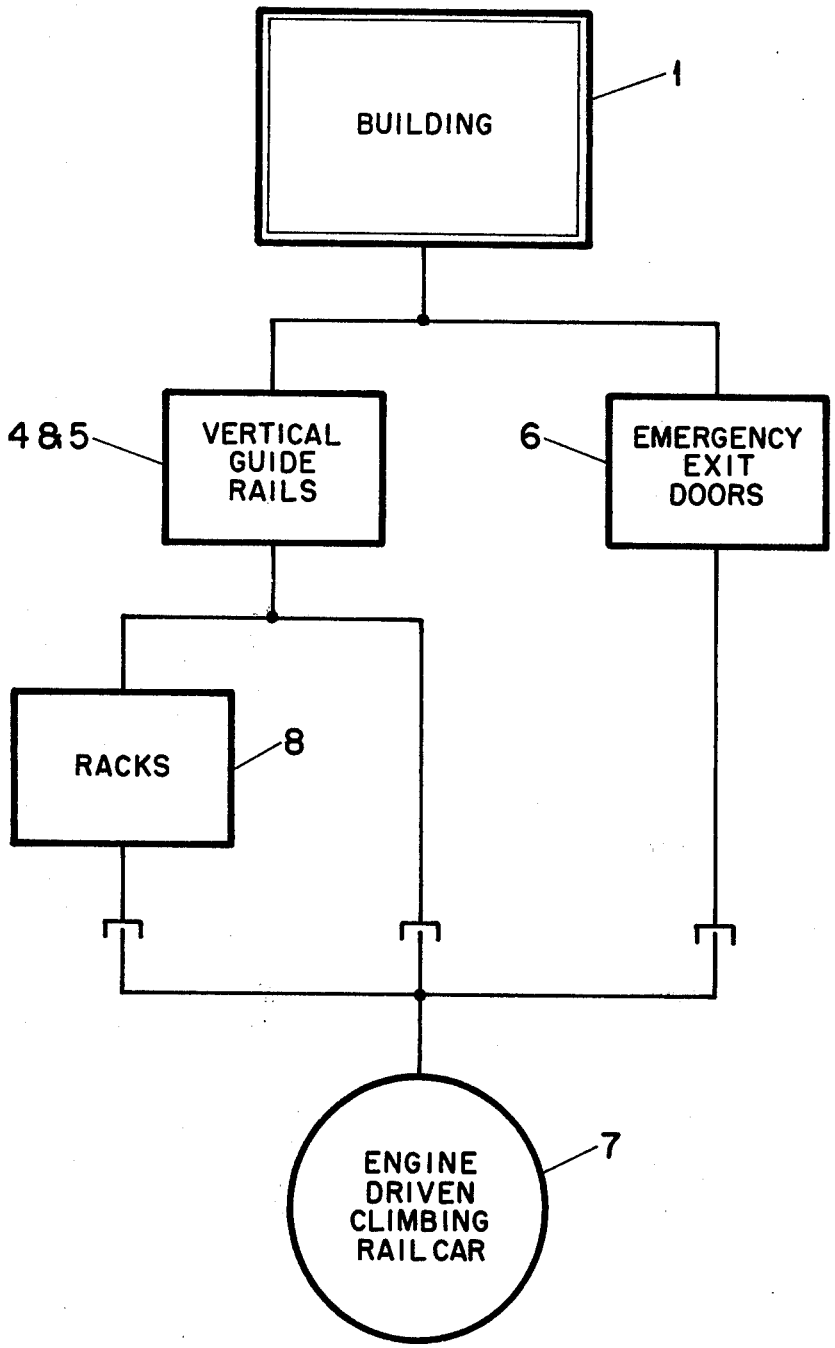

A second version of the invention in which the mobile unit comprises a railcar powered by motor or engine which climbs the vertical rails by rack and pinion drive is shown in block diagram in FIGS. 14 and 15 and in a side view of FIG. 13.

Figure 16:
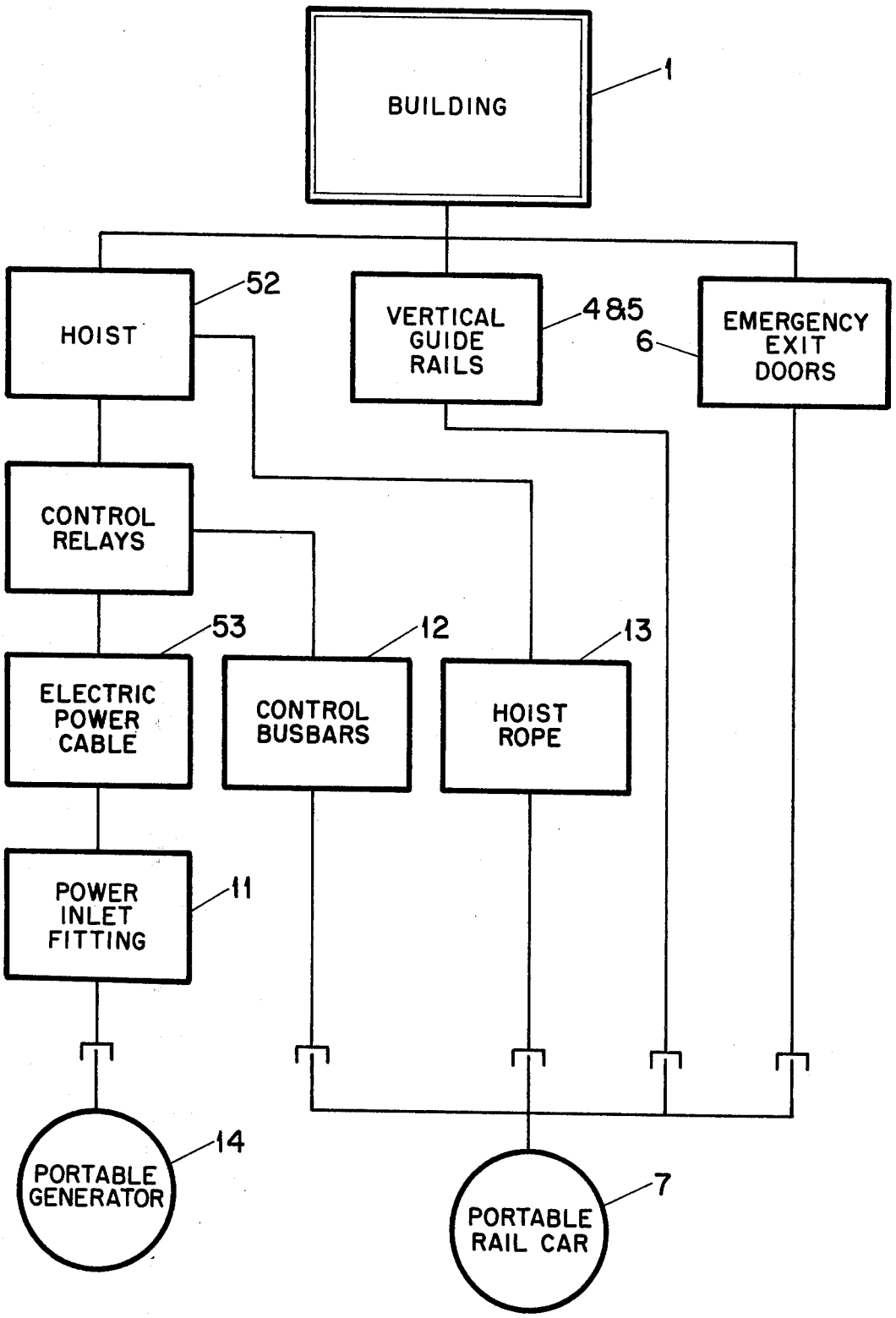
Figure 17:
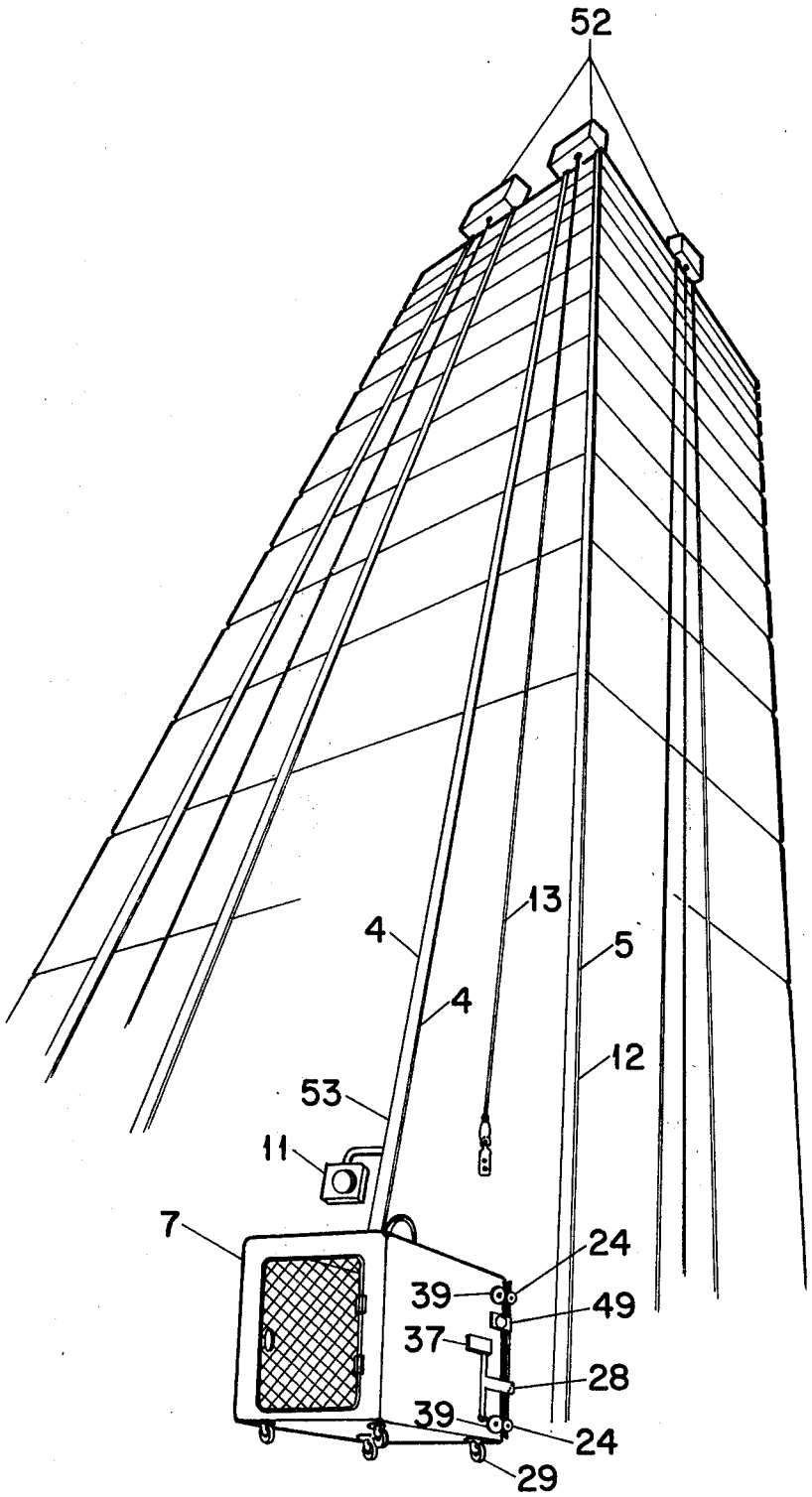
Figure 18:
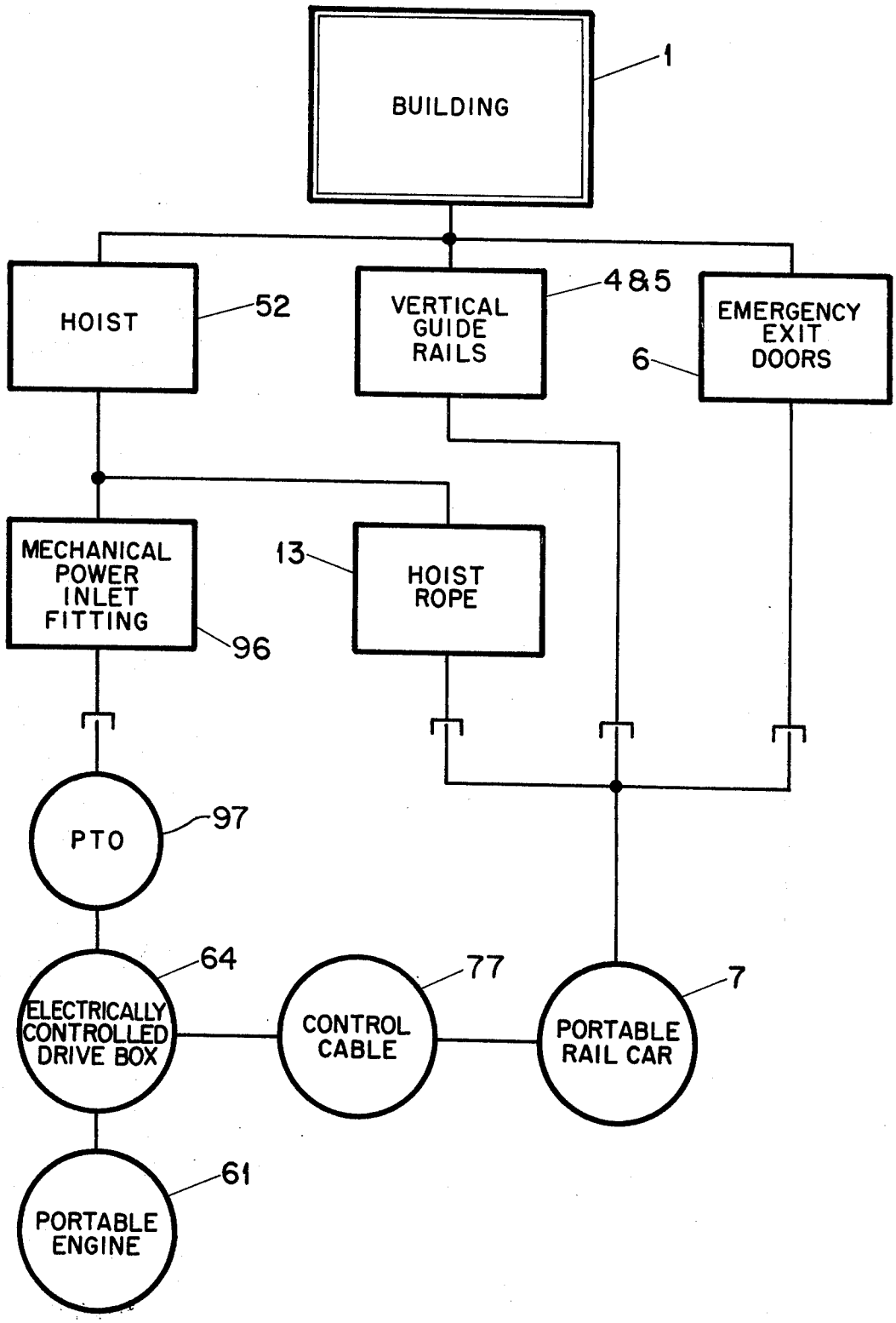

A third version of the invention in which a hoist is a part of the vertical railroad is shown in block diagram in FIGS. 16 and 18 are schematics FIGS. 17, 19, 20, and 21.

Figure 22:
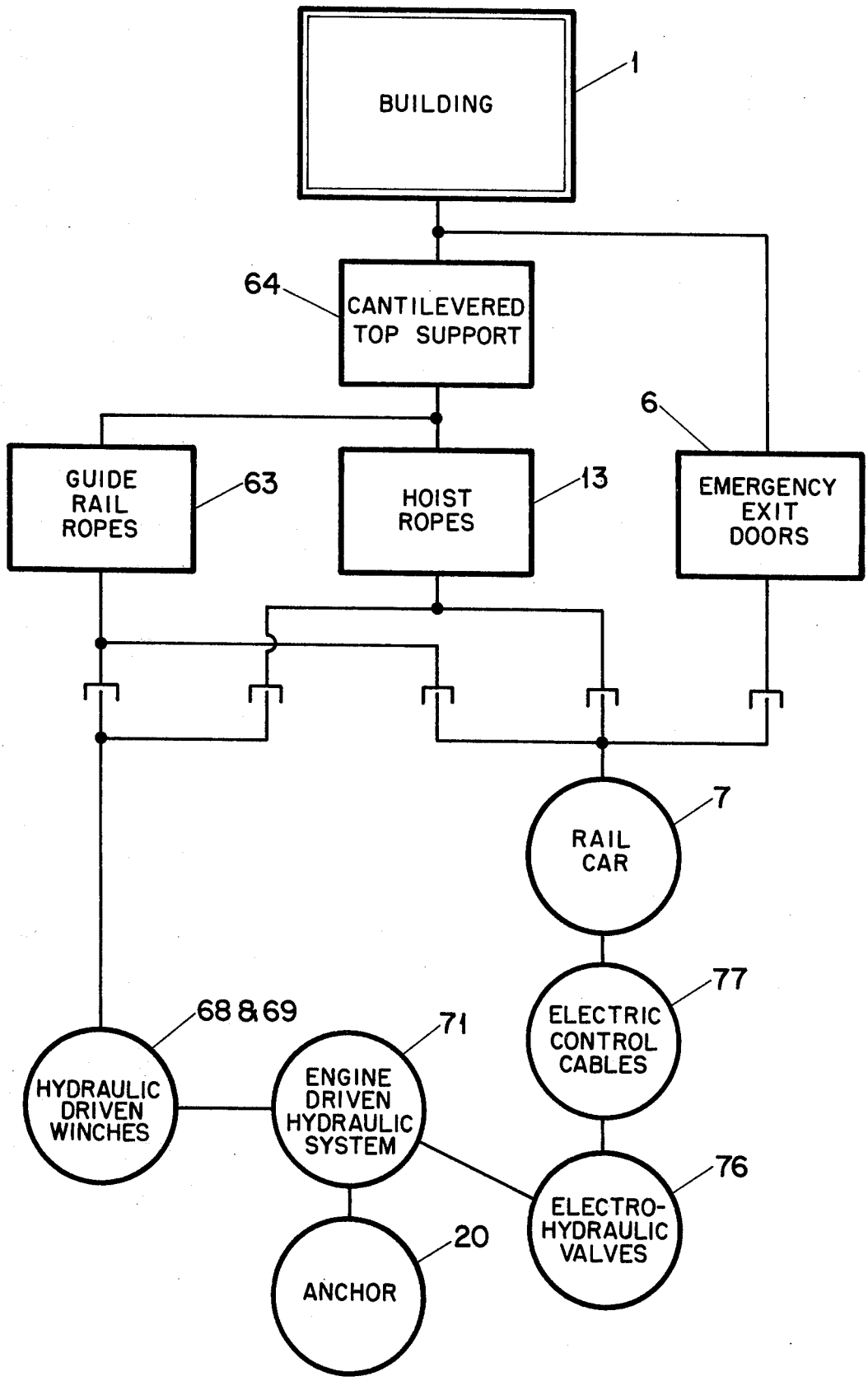
Figure 31:
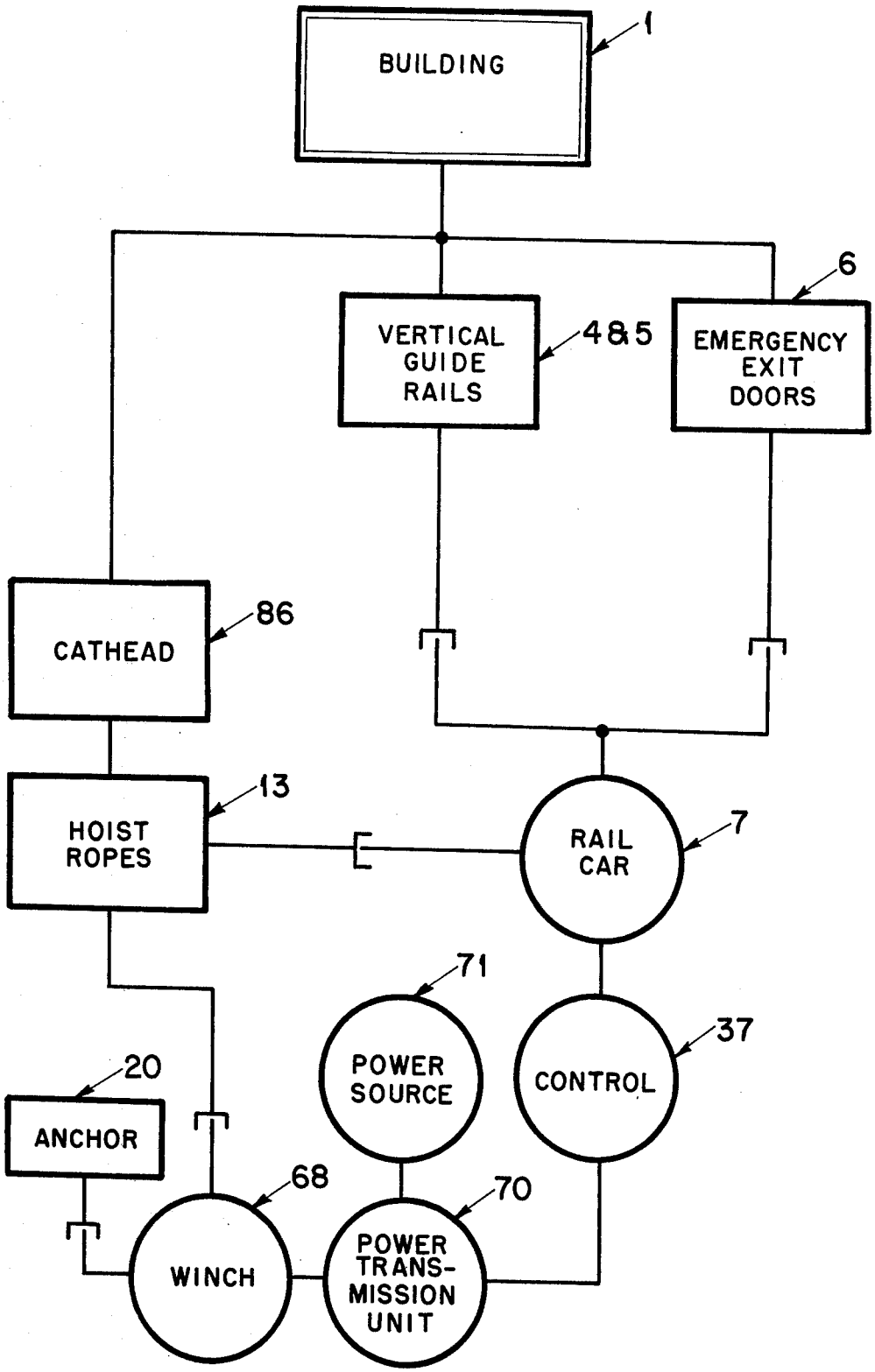
Figure 32:
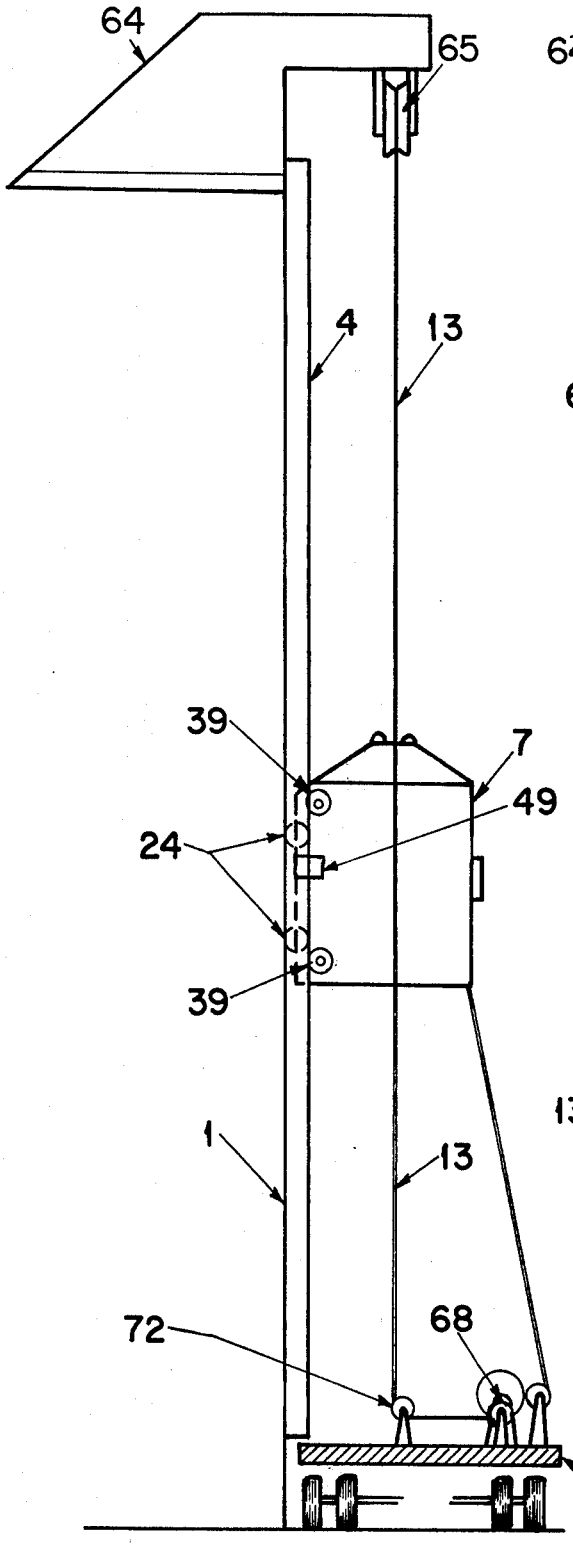
Figure 33:
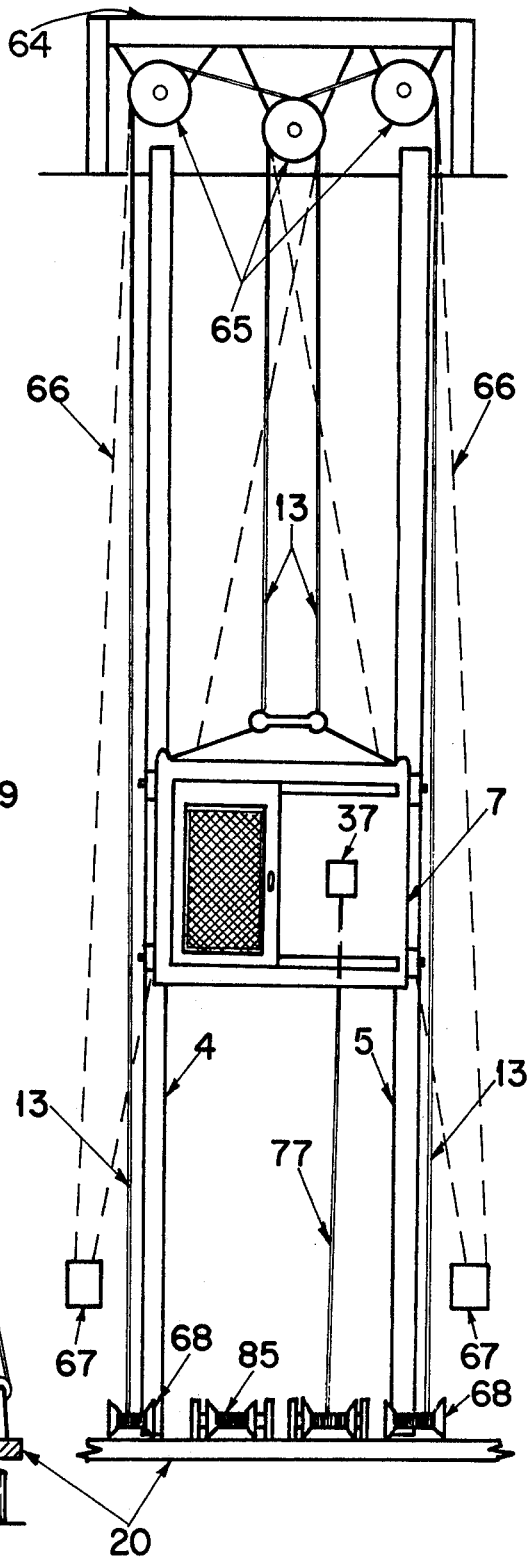
Figure 34:
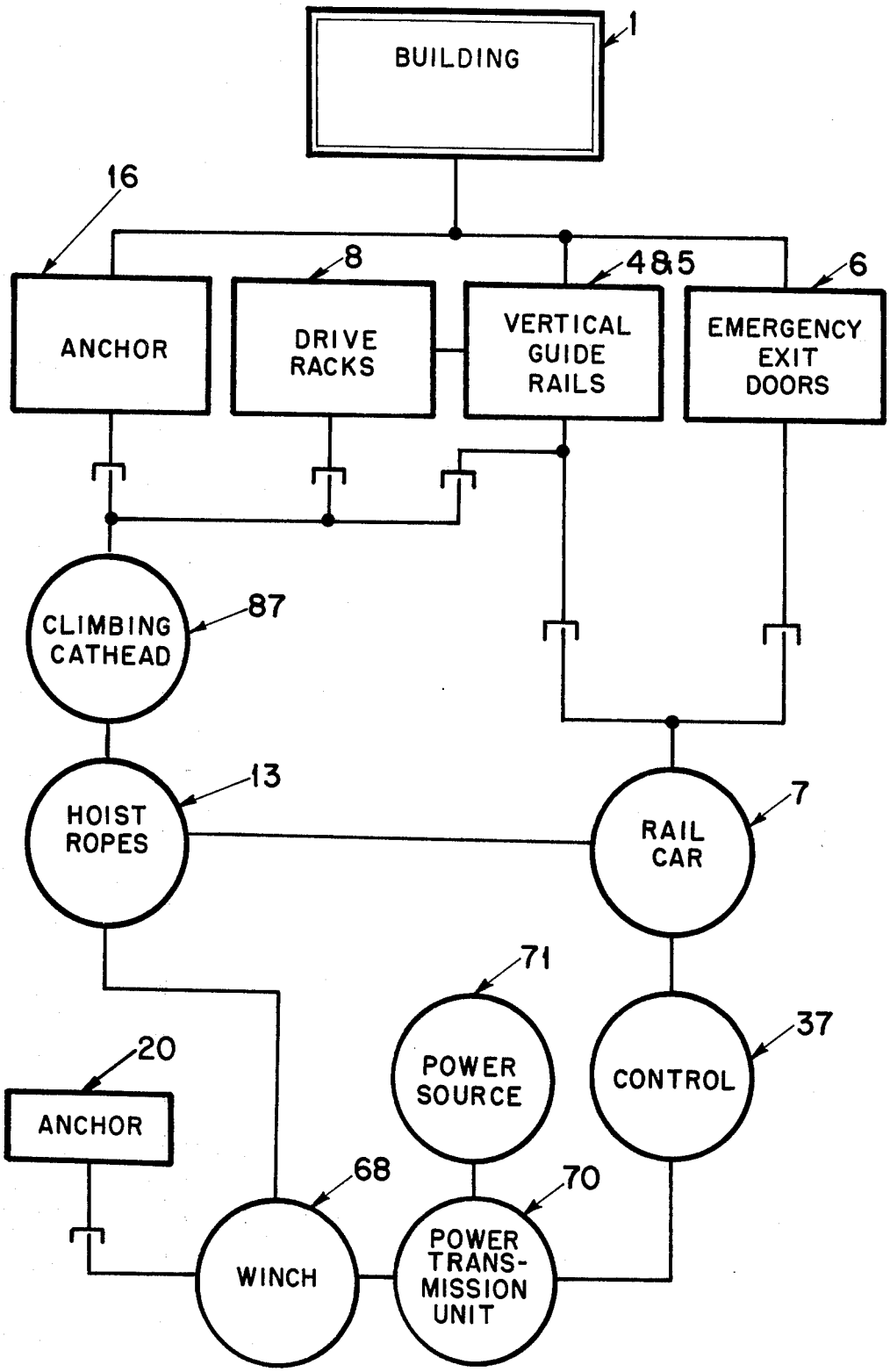

A fourth version shown in block diagrams FIGS. 22, 31, and 34 and schematics FIGS. 23 through 28, 32, 33, and 35 has an engine-powered winch in the mobile unit and a cathead permanently attached to the building or a climbing cathead. In this version, FIGS. 22 through 28 feature a flexible element drawn taut for a vertical rail. A railcar devised for interchangeable use on rigid or taut rope rails is shown in FIG. 36.

Figure 29:
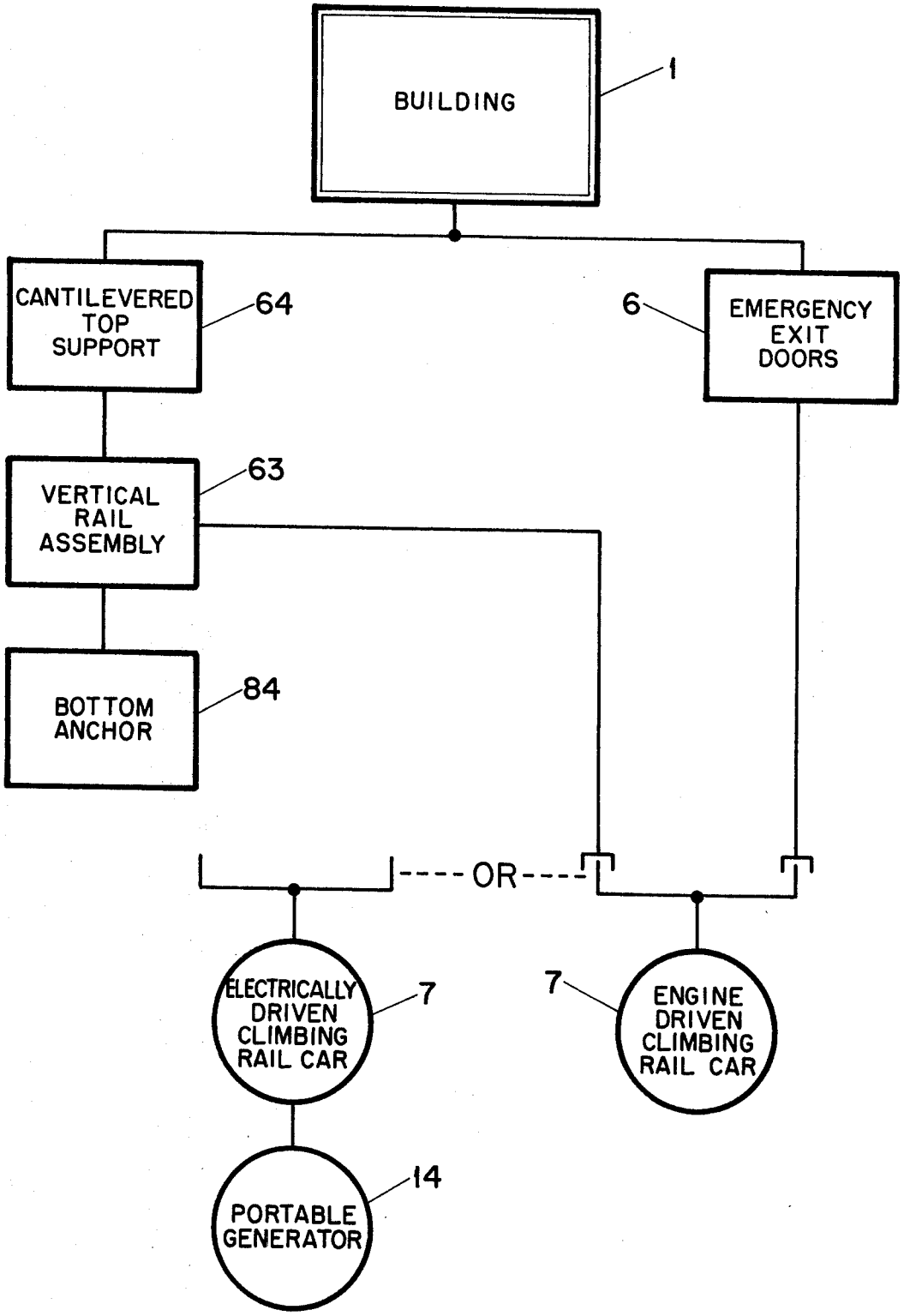
Figure 30:
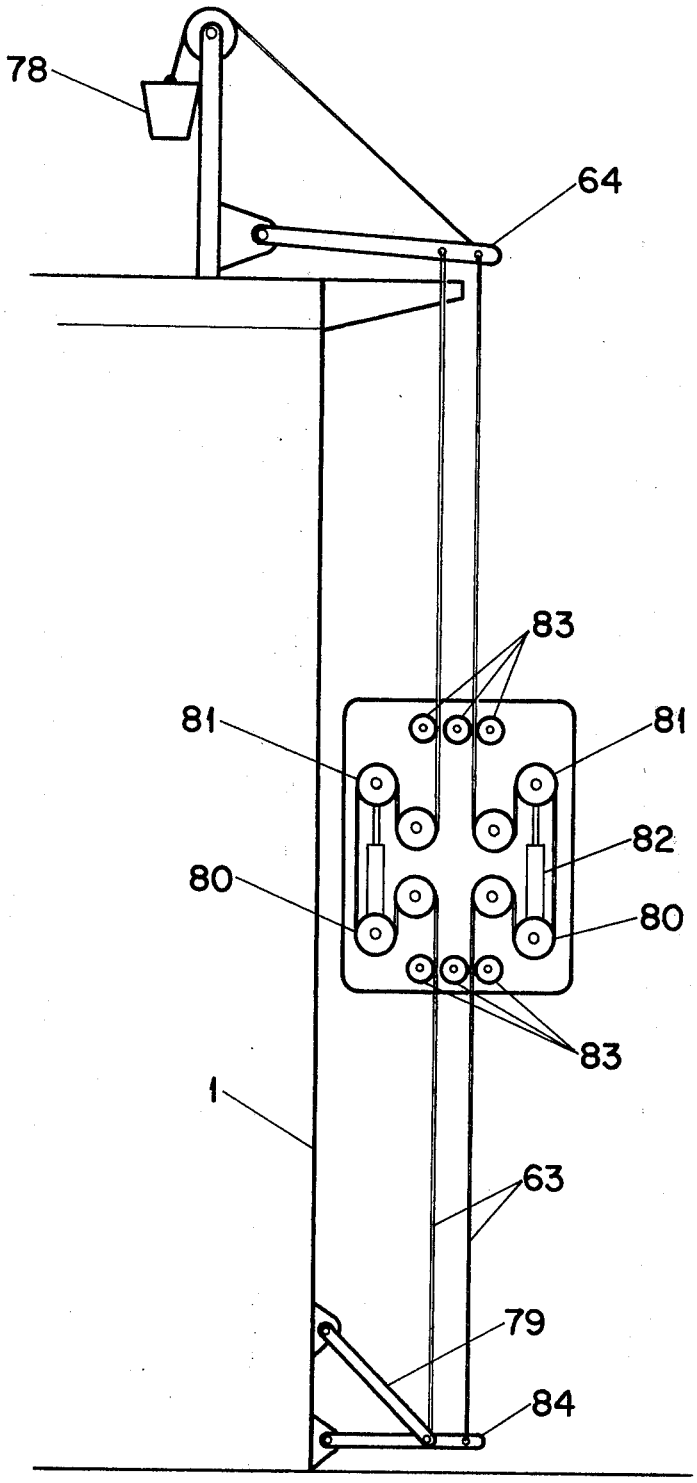

A fifth version of the invention in which a railcar powered by engine or motor climbs a taut rope is shown in block diagram FIG. 29 and schematic FIG. 30.

DETAILED DESCRIPTION OF THE INVENTION

Figure 1:
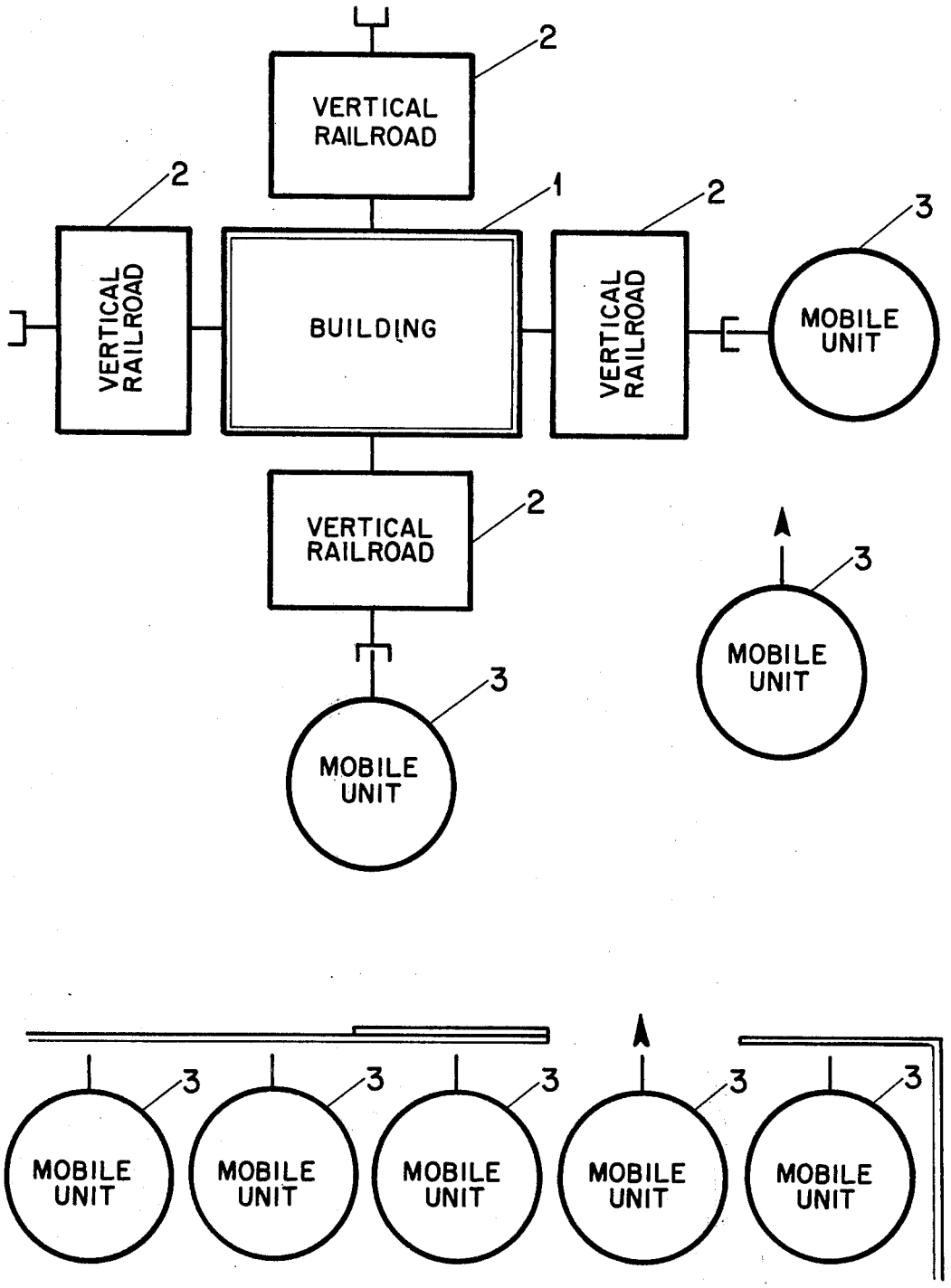
FIG. 1 is a block diagram of a basic emergency building access apparatus according to the invention. In each of the block diagrams all units to be permanently attached to the building are shown in boxes while all units to be a part of the mobile units are shown in circles.

The Emergency Building Access Apparatus is shown first in the block diagram of FIG. 1 as attached to a four sided building 1 as viewed from above. In this diagram, a vertical railroad unit 2 is installed on each of the four vertical walls of the building 1 to provide to the building at each floor of the building in an emergency. Each vertical railroad 2 is designed to provide only the essentials in fixed gear so that mobile units 3 may be coupled to any one or more of the vertical railroads 2 providing thereby a complete apparatus for emergency evacuation of building occupants and access by firemen and their equipment. A fleet of mobile units 3 in a standardized system can be maintained at a central location as shown at the bottom of the diagram in a group of high rise buildings and be ready and available for emergency situation in any one of the buildings.

A variety of designs of such vertical railroads 2 and mobile units 3 can make up the Emergency Building Access Apparatus of this invention and are disclosed herein to meet the following requirements a. safety
b. high reliability
c. short startup time
d. high speed operation, passenger feet per minute
e. reasonable load capacity
f. completely independent power supply
g. design flexibility to provide access to many areas of the building
h. low capital cost of fixed permanent equipment
i. low maintenance and repair cost of fixed equipment
j. ability of the fixed equipment to blend into the building aesthetics, and
k. simplicity

THE CLIMBING HOIST VERSION

Figure 2:
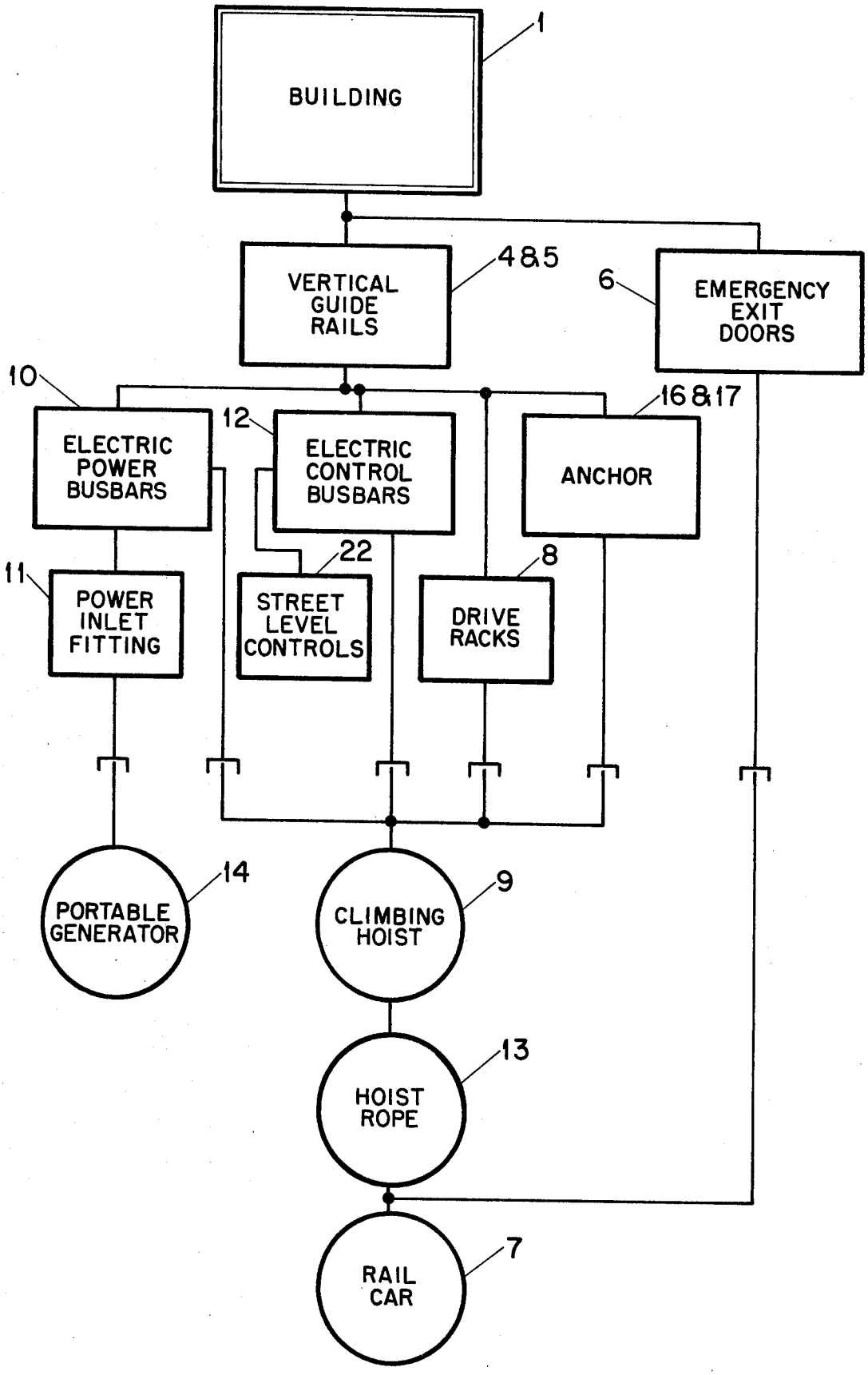

In FIG. 2 is shown a block diagram of a vertical railroad 2 and mobile unit 3 utilizing the outside elevator concept of U.S. Pat. No. 3,763,964 of Davis. In this Emergency Building Access Apparatus the vertical railroad 2 which is attached permanently to the building 1 comprises a pair of vertical guide rails 4 and 5, and an emergency exit door 6 at each floor of the building 1 between the rails 4 and 5 which doors 6 are designed to be opened only from the outside of the building, although existing hall windows, outside walkways, or balcony doors could serve as emergency exit doors.

The vertical guide rails 4 and 5 provide guiding surfaces for a sliding support for the railcar 7 from the base to the top of the building 1 and drive racks 8 for a rack and pinion drive or electrically driven traction wheels acting against rails 4 and 5 for a frictional drive for a climbing hoist 9. A set of electrical power transmission busbars 10 are attached to one of the rails 4 and insulated therefrom for the full length of the rails. The power busbars 10 are in turn connected to a power inlet fitting 11 installed on the building 1 at street level. A set of electrical control busbars 12 are attached full length to the other rail 5 and insulated therefrom. This is the complete vertical railroad unit 2 to be permanently attached to the building 1 at each desired point.

Each mobile unit 3 comprises a climbing hoist 9 attached to a railcar 7 by hoist rope 13 and a portable generator 14. For operation of the complete Emergency Building Access Apparatus the mobile unit 3 is brought up to the base of a vertical railroad 2. The portable generator 14 is connected to the power inlet fitting 11 with its outlet cable 15. The climbing hoist 9 is engaged with the guide rails 4 and 5, electrical power busbars 10 and electrical control busbars 12. When the climbing hoist 9 has reached the top of the building 1, it is secured to the anchor support 16 by the anchoring attachment 17 on the hoist 9. The railcar 7 is then engaged with the rails 4 and 5 and the control busbars 12. In operation, access to the railcar 7 from the building 1 is through the emergency exit doors 6.

Figure 3:
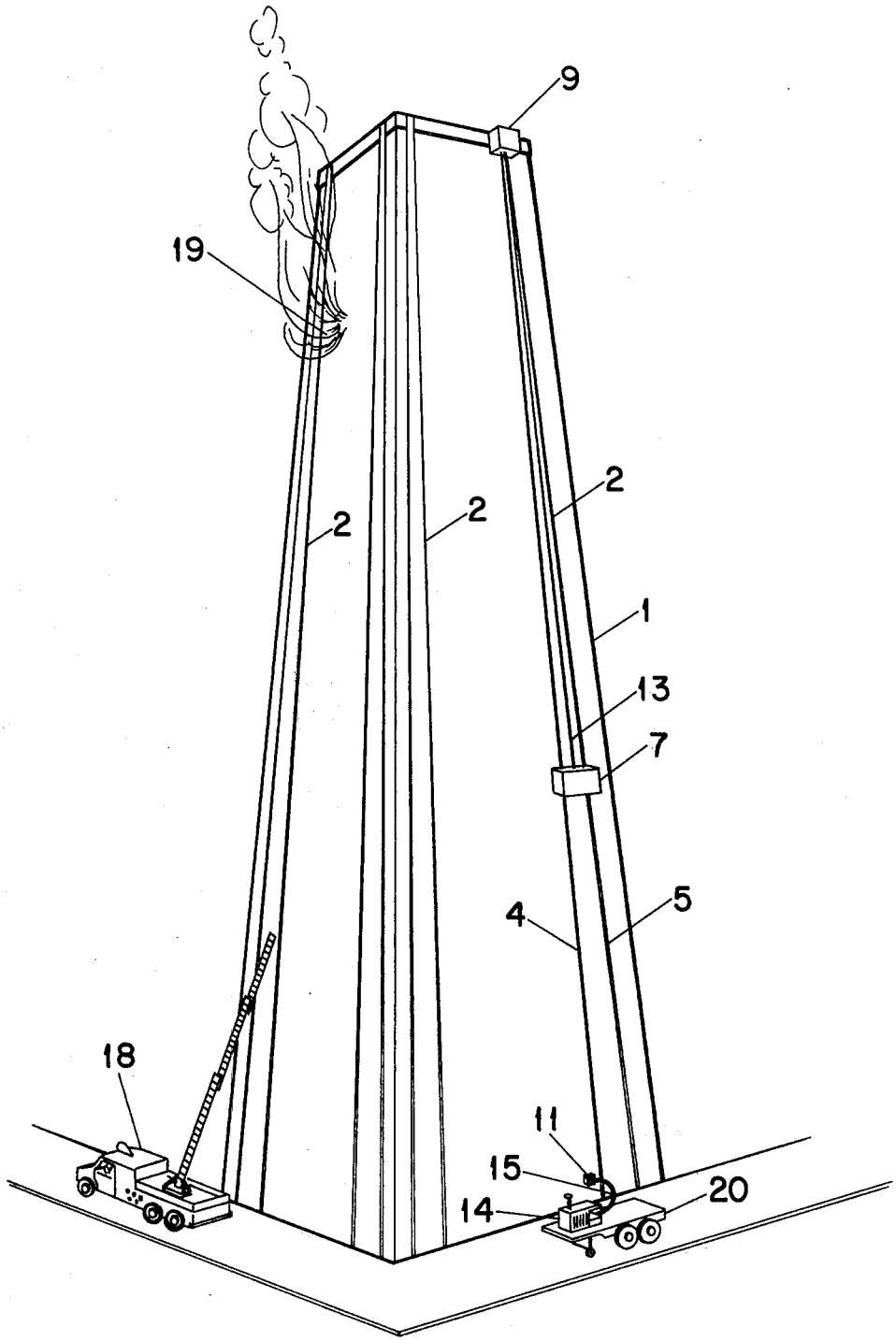

The Emergency Building Access Apparatus of FIG. 2 is shown in operation on a building 1 in FIG. 3. The relative ineffectiveness of the convention but modern fire truck with ladder 18 which reaches only the lower floors and can serve as a relatively slow and somewhat hazardous method of removing occupants from a building is contrasted with the Emergency Building Access Apparatus of this invention with the mobile unit 3 installed on a vertical railroad 2 on a safe side of building 1 away from emerging smoke and flames 19. In this system the building 1 is equipped with two vertical railroads 2 on each side of the building 1. The climbing hoist 9 is anchored at the top of the vertical railroad 2 and the railcar 7 is being raised and lowered on the vertical railroad 2 by hoist rope 13 and climbing hoist 9. Electrical power to operate climbing hoist 9 is transmitted to it both for climbing and hoisting by power busbars 10, power inlet fitting 11 and a power cable 15 from the portable generator 14 mounted on the transport unit 20 which hauled the mobile unit 3 to the vertical railroad 2.

Figure 4:
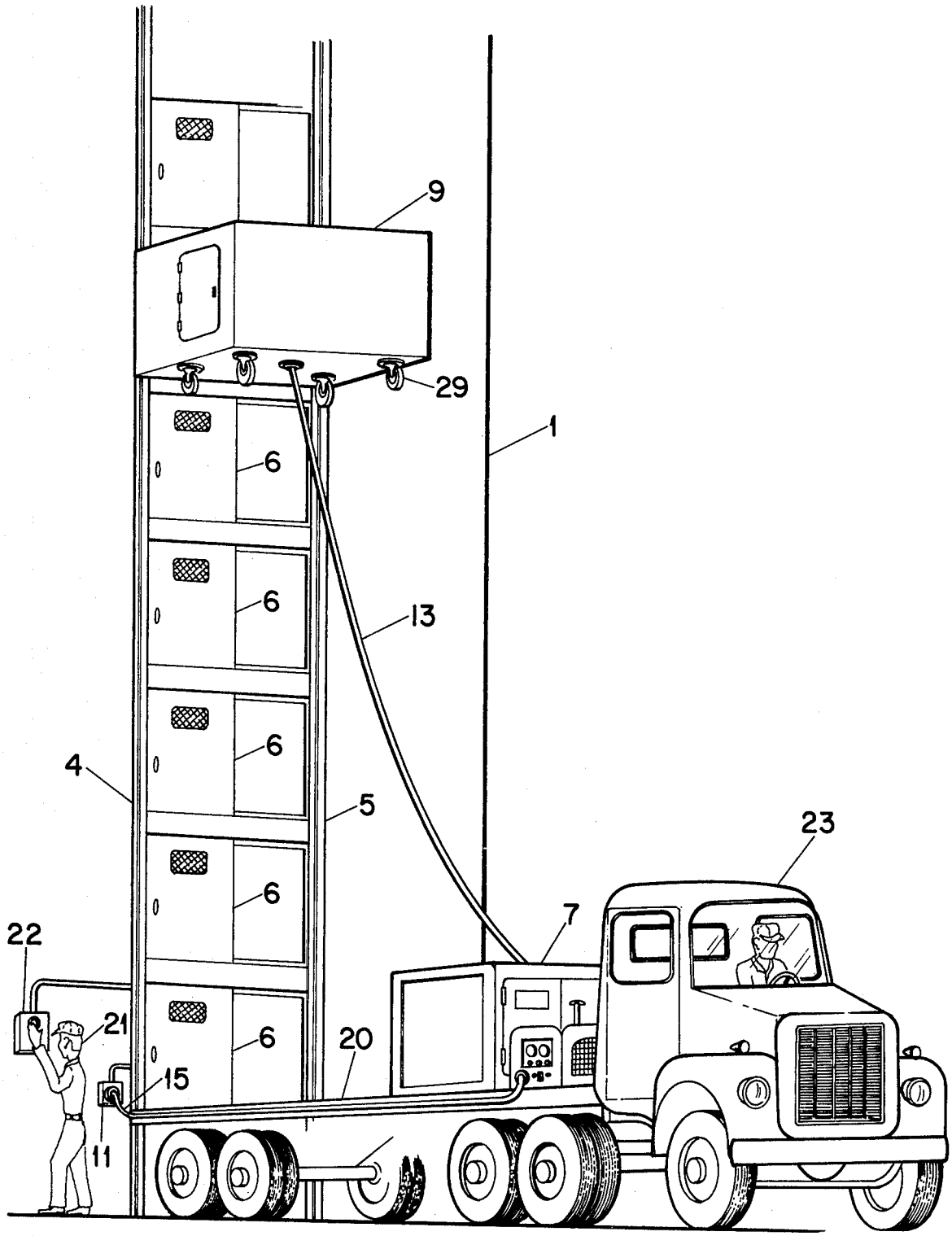
Figure 6:
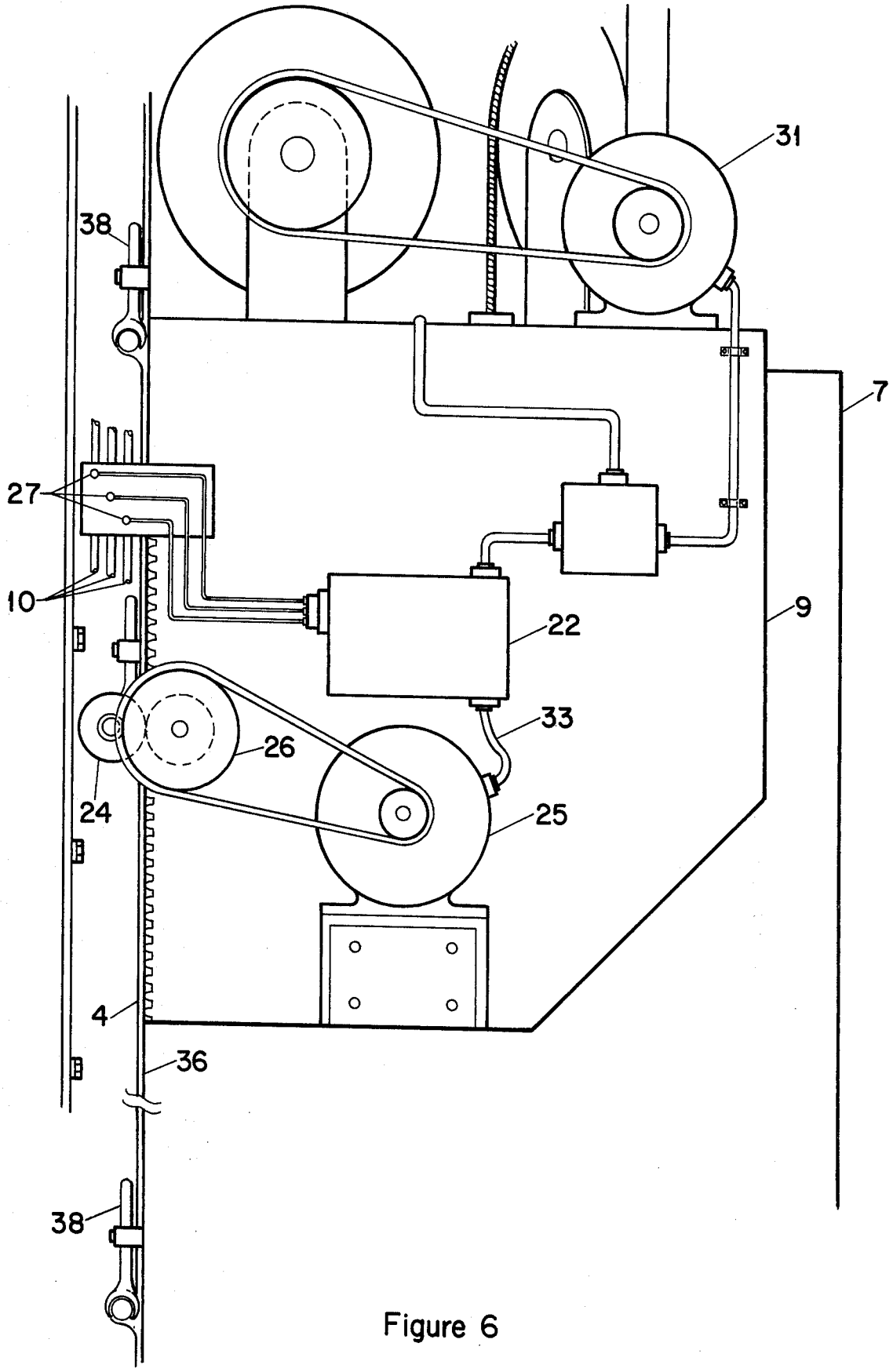
FIG. 6 shows a side view of the climbing hoist with the railcar close coupled beneath it for raising and lowering of the climbing hoist.
Figure 7:
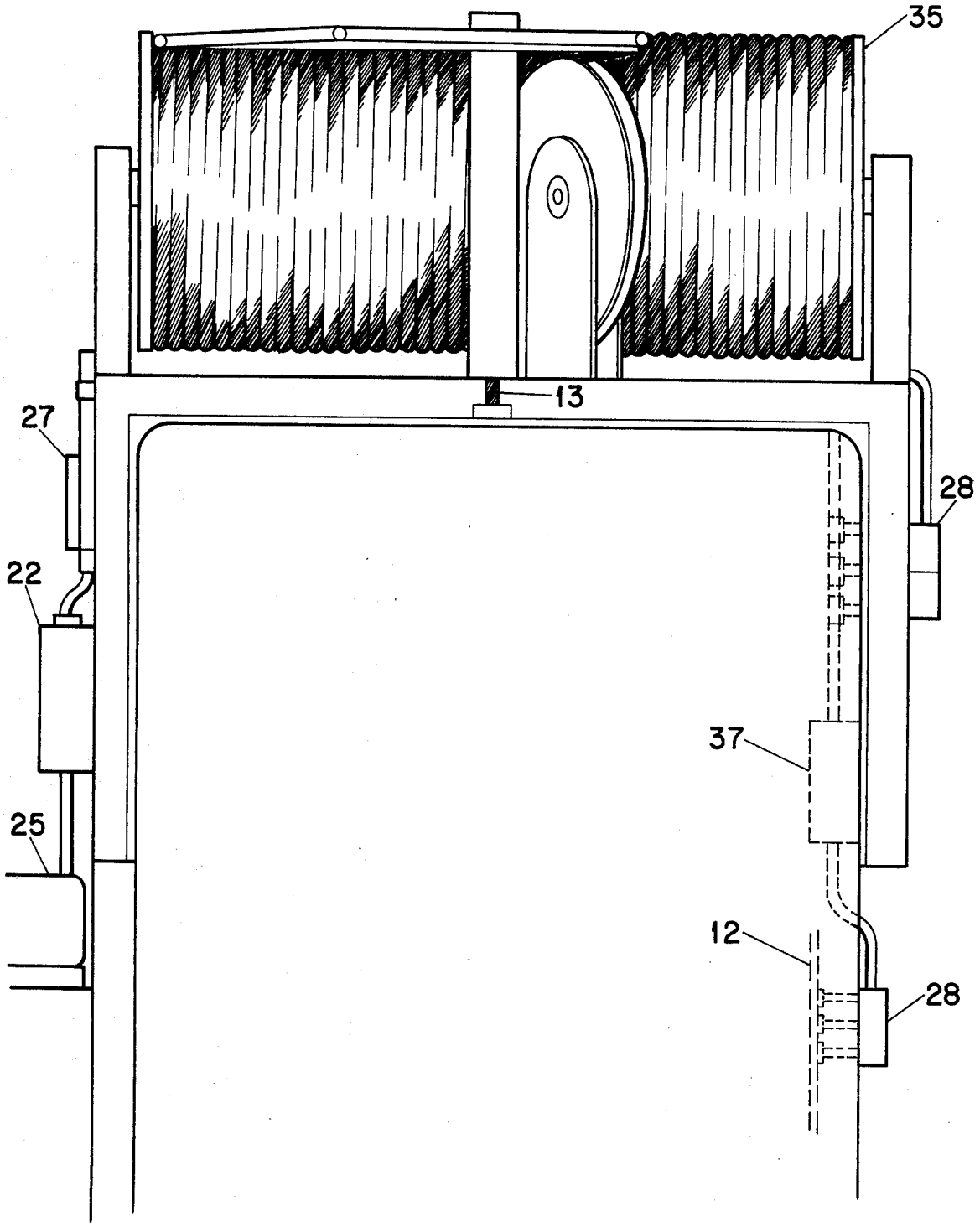
FIG. 7 shows the outside walls of the same hoist and railcar as seen from the street.

A closeup view of the Emergency Building Access Apparatus of FIG. 2 is shown in FIG. 4 with the climbing hoist 9 being raised on the vertical railroad 2 from street level at the base of the building 1 with an operator 21 manning and climbing controls 22 at street level. The truck tractor 23 and semi-transport trailer 20 which transported the mobile unit 3 to the site is backed up against the vertical railroad 2 and the power cable 15 from the portable generator 14 is connected to the power inlet fitting 11. Guide wheels 24 on the climbing hoist 9 are engaged with guide rails 4 and 5 and the climbing hoist 9 is raised and lowered on the vertical railroad 2 by climbing motor 25 driving a pinion 26 engaged with drive racks 8 on the guide rails 4 and 5. Electrical power is fed to climbing motor 25 by contact brushes 27 contacting power busbars 10 on one face of the web of the rail 4 as shown in FIG. 6 while the climbing motor 25 is controlled to raise, lower, or stop by relays on the hoist 9 and as operated by controls 22 connected to the climbing hoist by control busbars 12 and contact brushes 28 on the opposite side of the railcar 7.

Wheels 29 on the base of climbing hoist 9 and railcar 7 facilitate moving the units along the deck of the trailer 20 into engagement with the rails 4 and 5. An emergency exit door 6 is shown at each floor. In a preferred embodiment the emergency exit doors 6 slide to the side on tracks 30 so as to not interfere with the railcar 7.

Figure 5:
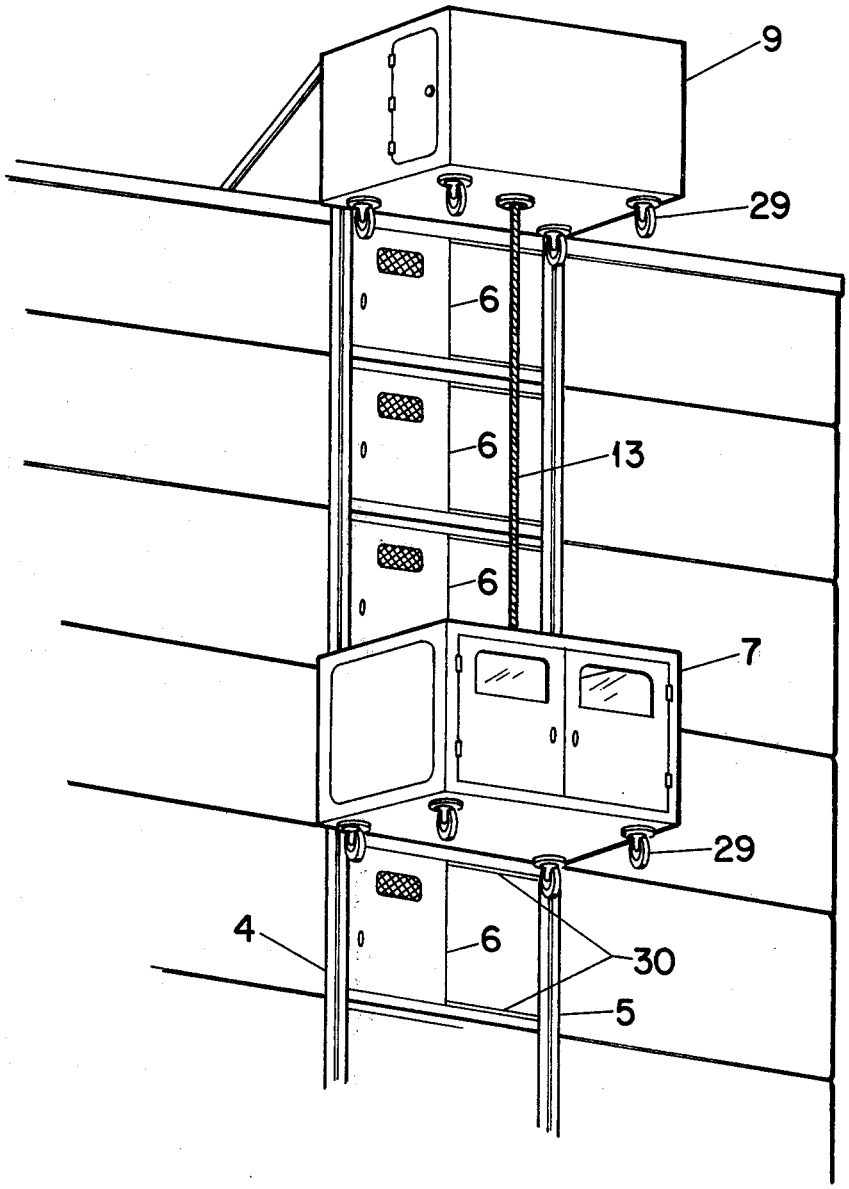

In FIG. 5 the climbing hoist 9 of FIG. 4 is shown raised to the top of building 1 at which point it has been stopped and achored so as to raise and lower the railcar 7 which is also now engaged with the rails 4 and 5. It is to be noted that the rails 4 and 5 may extend above the top story of the building 1 so as to allow drawing the railcar 7 up alongside the top story for access to it.

As seen in FIGS. 6, 7, 8 and 9 in a variation of the Emergency Building Access Apparatus of FIG. 2 the frame of the climbing hoist 9 overlies the top of the railcar 7 with the climbing controls 22 on one side of its climbing hoist 9 for operation through an opening in the wall of the railcar 7 by a fireman or operator riding in the railcar 7 so that climbing hoist 9 and railcar 7 can be raised to the top of the building 1 closely coupled. Thus more precise anchoring of the climbing hoist 9 to the top of the building 1 may be accomplished by the railcar operator with the need for limit switches at the top of the building, control busbars 12 and contact brushes 28 for climbing, eliminated. When the operator has anchored the climbing hoist 9 to the top of the vertical railroad 2 he may descend to the desired floor and pick up passengers. Power is supplied to the hoist motor 31 by control switches in control box 22 from power busbars 10 and contact brushes 27. Power is led to climbing motor 25 by cable 33. Power from control box 22 is fed to the hoist motor 31 to raise, lower and stop the railcar 7 by control relays in box 22 as controlled by switches 37 in the railcar 7 connected to the relays through busbars 12 in contact wih contact brushes 28 on the railcar 7 and climbing hoist 9. Hoist rope 13 is wound on and paid out from hoist drum 35 to raise and lower the railcar 7.

Figure 8:
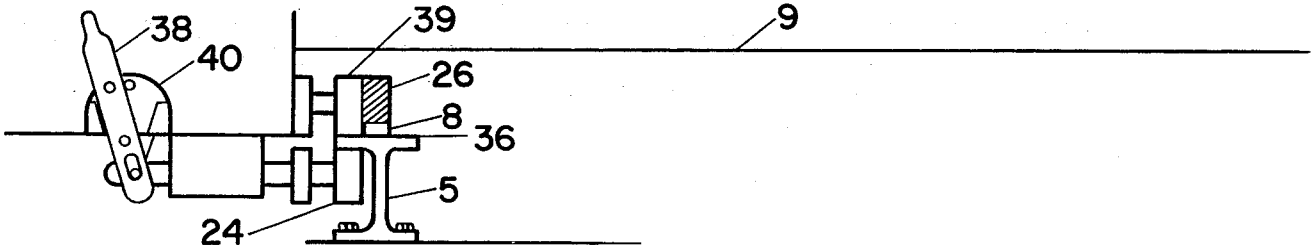
FIGS. 8 and 9 show details of a means to engage the railcar and/or hoist with the vertical rails by use of retractable inside guide wheels.

Guide rollers 24 are required on the inside face of the flanges 36 and rails 4 and 5 at the bottom of the climbing hoist 9 so as to hold climbing drive pinions 26 against the drive racks 8 on the face of rails 4 and 5 and at the top to withstand the upper force of the couple resulting from the load on the hoist rope 13 spaced out from the building wall. In mounting the hoist 9 on the building, guide rollers 24 are retracted inwardly toward the center by levers 38 and the climbing hoist 9 is pressed against the rails 4 and 5 with outside guide rollers 39 pressed against the rail flanges 36 and drive pinions 26 pressed against and meshing with the drive racks 8. Levers 38 are then moved into position as shown in FIG. 8 driving guide rollers 24 in behind the rail flange 36. Lockpins 40 are then put in place to prevent the release of guide rollers 24.

Figure 9:
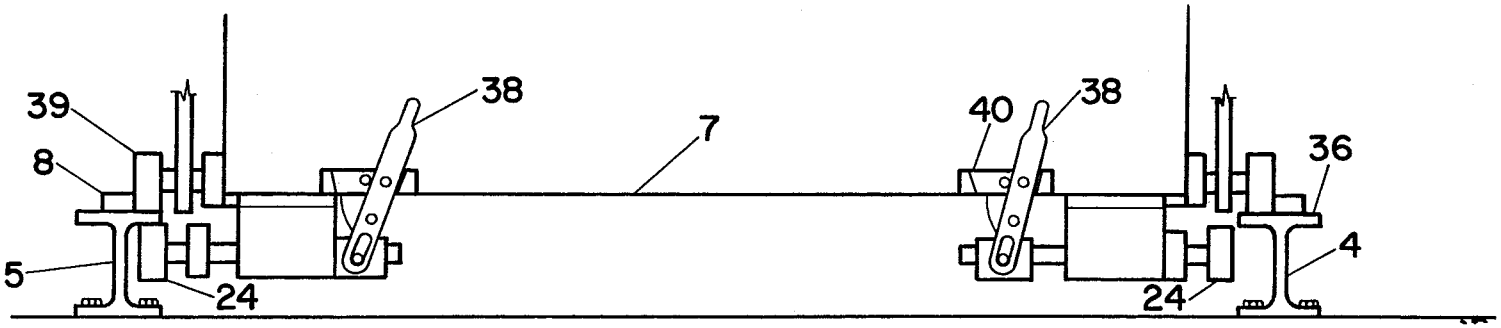

The railcar 7 is engaged with the rails 4 and 5 in similar manner as shown in FIG. 9. No drive pinion is required on this version of railcar as it is raised and lowered on the rails 4 and 5 by climbing hoist 9 after the latter is anchored.

Figure 10:
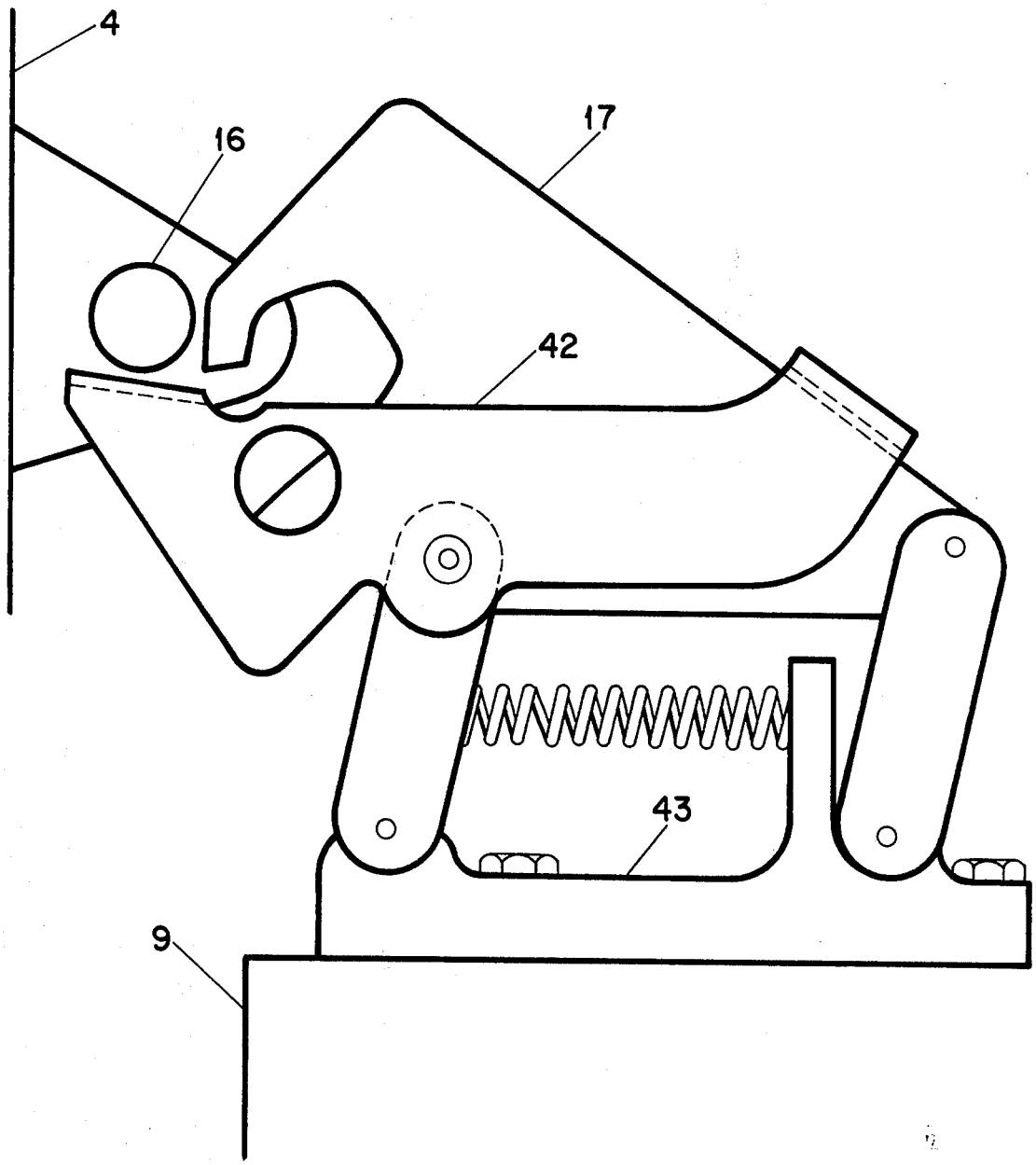
FIG. 10 shows an anchoring device to anchor the climbing hoist to the vertical railroad.

A typical anchor as attached to the top of the climbing hoist 9 is shown in FIG. 10 as a latch similar to those used on extension ladders with spring biased hook 17 and override cam arm 42 pivotally attached to base 43 which in turn is attached to the top of the climbing hoist 9. In operation, as the climbing hoist 9 rises, cross bar 16 cams hook 17 away from the rail 4, arm 42 away from the hook opening, and then hook 17 is biased back against bar 16 for a supporting engagement should the climbing hoist be stopped. If a series of cross bars 16 are attached to the rail 4 allowing anchoring at more than one level on the building, the climbing hoist 9 may be raised above each cross bar 16 and, if so the hook 17 will merely ride past to return hook 17 and arm 42 to their former position. As the climbing hoist 9 is lowered with the hook 17 and arm 42 in the disengaged biased position, arm 42 serves to cam the hook 17 away from engagement with cross bar 16. In a preferred embodiment an anchoring attachment would be used at each side of the climbing hoist 9 to anchor to both rail 4 and rail 5 and thus to the building 1.

An alternate method of engaging railcar 7 and climbing hoist 9 with the rails 4 and 5 is shown in FIG. 11, 12 and 13 in which removeable sections 45 of rail flange 36 are installed with the climbing hoist 9 and pinned to the fixed rails 4 and 5 by pins 46 and the climbing hoist 9 is then raised above the removeable sections 45. Next, the removeable sections 45 are demounted and the railcar 7 with a second set of removeable flanges 45 as shown in FIG. 13 is brought up to the fixed rails 4 and 5, the removeable flanges 45 pinned to the fixed rails 4 and 5 with pins 46. The removeable rail sections 45 remain in place on the fixed rails 4 and 5 during operation of the Emergency Building Access Apparatus. The railcar 7, climbing hoist 9, and both sets of removeable rail sections 45 are then removed in reverse order. A jacking device 47 as shown in FIG. 13 can be used to facilitate vertical alignment and dolly wheels 29 facilitate moving the railcar 7 or climbing hoist 9 into horizontal alignment with the fixed rails 4 and 5. Each rail section 45 comprises a flange which matches the flange of the rail with rack 8. The rail sections may be short as in FIGS. 11 and 12 or long as in FIG. 13. The longer sections could have sufficient tolerance to obviate the need for jacks 47.

CLIMBING RAILCAR

In FIGS. 14 and 15 are shown block diagrams of a second version of the Emergency Building Access System of invention in which the rails 4 and 5 of the vertical railroad 2 have drive racks 8 and the railcar 7 has a climbing motor 25 and drive pinions 26 to engage with the drive racks 8. In the version of FIG. 14 and also shown in FIG. 13 the climbing motor 25 is electrical deriving its power from a portable generator 14 connected to the power inlet fitting 11 through electrical power busbars 10 on the web 4. No control busbars are required as the electrical controls 37 to cause the railcar 7 to rise, lower, or stop are in the railcar 7. It is to be noted that in all cases an alternate electricity transmitting means for power or control busbars may be insulated cables on rewind reels. Also as shown in FIG. 13 an overspeed governor and emergency brake unit 49 of conventional design as used on construction elevators mounted on the side of the climbing railcar 7 engages the rail flange 36. Where a single long removable rail flange 45 is used as in FIG. 13 all such elements of the railcar are engaged at one time thus simplifying engagement of the railcar 7 with the fixed rail system. The drive motor may alternately be a propane, gasoline or diesel-powered engine 50 with a climbing drive system including forward and reverse gearing, clutches and brake as in the block diagram of FIG. 15 thus requiring no busbars, power inlet fitting or portable generator. In such a version the climbing railcar 7 is merely moved up to the vertical railroad 2 and engaged therewith, the engine 50 started, and the climbing railcar 7 then controlled by the operator to move to any story of the building 1. Climbing speed of contemporary rack and pinion driven man and material hoists used in construction is 150 feet per minute. Cable driven units travel at speeds in excess of 200 feet per minute.

HOIST FIXED TO VERTICAL RAILROAD

The Emergency Building Access Apparatus of this invention may also be in the form shown in block diagram FIG. 16 and the drawing of FIG. 17 wherein the vertical railroad 2 includes a permanently installed electrically driven hoist 52 at its top with electrical power cables 53 laid in the rail 4 from the hoist 52 to a power inlet fitting 11 at street level and having control busbars 12 installed for the length of rail 5 from control relays in the hoist 52. The mobile unit 3 comprises a portable generator 14 which plugs into the power inlet fitting 11 and a railcar 7 which engages the hoist rope 13, rails 4 and 5, and control busbars 12 with contact brushes 28. Disadvantages of such an embodiment of this invention are higher capital and maintenance cost per vertical railroad and advantages include ready operation.

Figure 19:
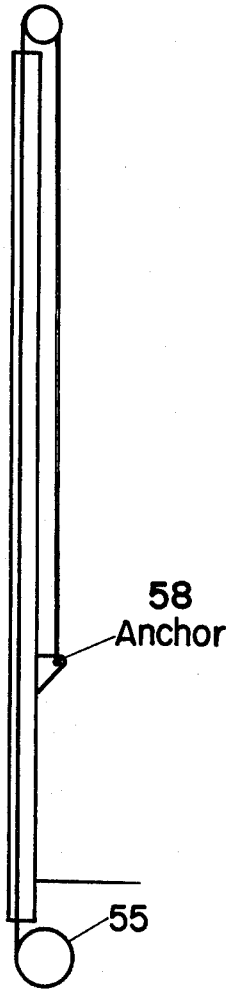
Figure 20:
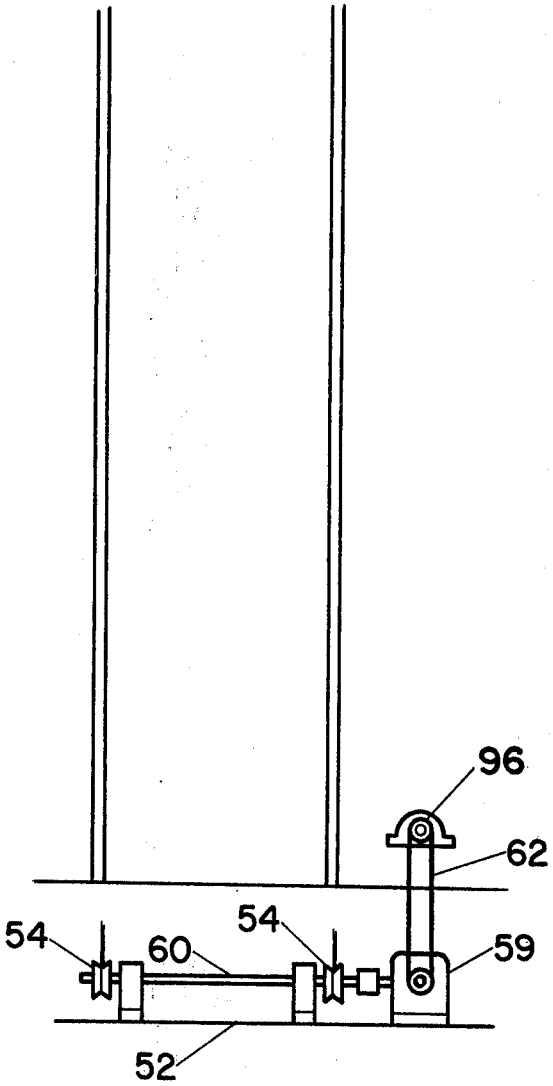
Figure 21:
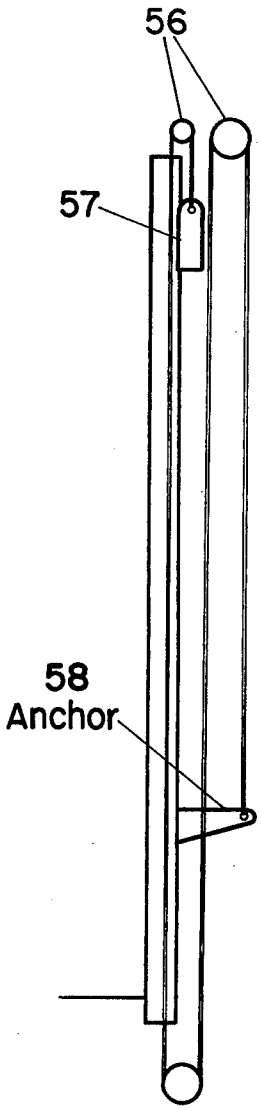

A variation of the E Building Access Apparatus having the hoist permanently installed as a part of the vertical railroad 2 is illustrated in block diagram FIG. 18 and schematics FIGS. 19, 20 and 21. In this version the permanently installed hoist 52 is at the base of the building 1 with its traction wheels 54 or drum 55. When driven by traction wheel 54 as in FIGS. 20 and 21 two top sheaves 56 support the counterweight 57 and the railcar 7. The rope to the railcar is attached to the fixed anchor 58 until the railcar is engaged with the vertical railroad. A right angle gear box 59 coupled to the drum or traction wheel shaft 60 is driven by the portable engine 61 which is a part of the mobile unit 3 though a chain drive 62 and a mechanical power inlet fitting 96 coupled with a power takeoff (PTO) 97 from the portable engine 61 and its electrically controlled drive box 64. An example of power inlet fitting 96 and the power take off (PTO) 97 are the splined slip joints and stub shaft as manufactured by Spicer for use on trucks and tractors. Control of the portable engine and drive box 54 having electricity controlled clutches and shifters therein is effected from the railcar 7 through an electrical control cable 77 on a takeup reel.

TAUT ROPE VERTICAL RAILROAD

A version of the Emergency Building Access Apparatus of my invention using in the vertical railroad 2 a flexible but taut rail 63 is illustrated in the block diagram of FIG. 22 and schematic FIGS. 23, 24, 25, 26 and 27. The vertical railroad 2 of this version thus includes a cantilevered structural support 64 at the top of the building 1 with top sheaves 65 (also called in the trade a cathead) to support rail ropes 63 and hoist ropes 13. Until the mobile unit 3 is engaged with the vertical railroad 2 and in its usual dormant but ready status temporary ropes 66 termed messengers are mounted or reeved on the top sheaves 65 and anchored in security boxes 67 at street level. These messengers are for the rail ropes and the hoist ropes, and may be lightweight dacron, nylon, or stainless steel selected for their dependability, long life, and resistance to corrosion. The mobile unit 3 of this version requires two hydraulically driven winches 68 receiving their power from an engine driven hydraulic system 71 or other drive system for each rope line. Thus a rail rope line 63 serving both sides of the railcar needs a winch 68 at each end, one of which will reel in the messenger line 66 upon engagement of the mobile unit 3 with the vertical railroad 2 preparatory to operation of the apparatus, and the other of which will pay out the heavier operating rope 13.

Figure 25:
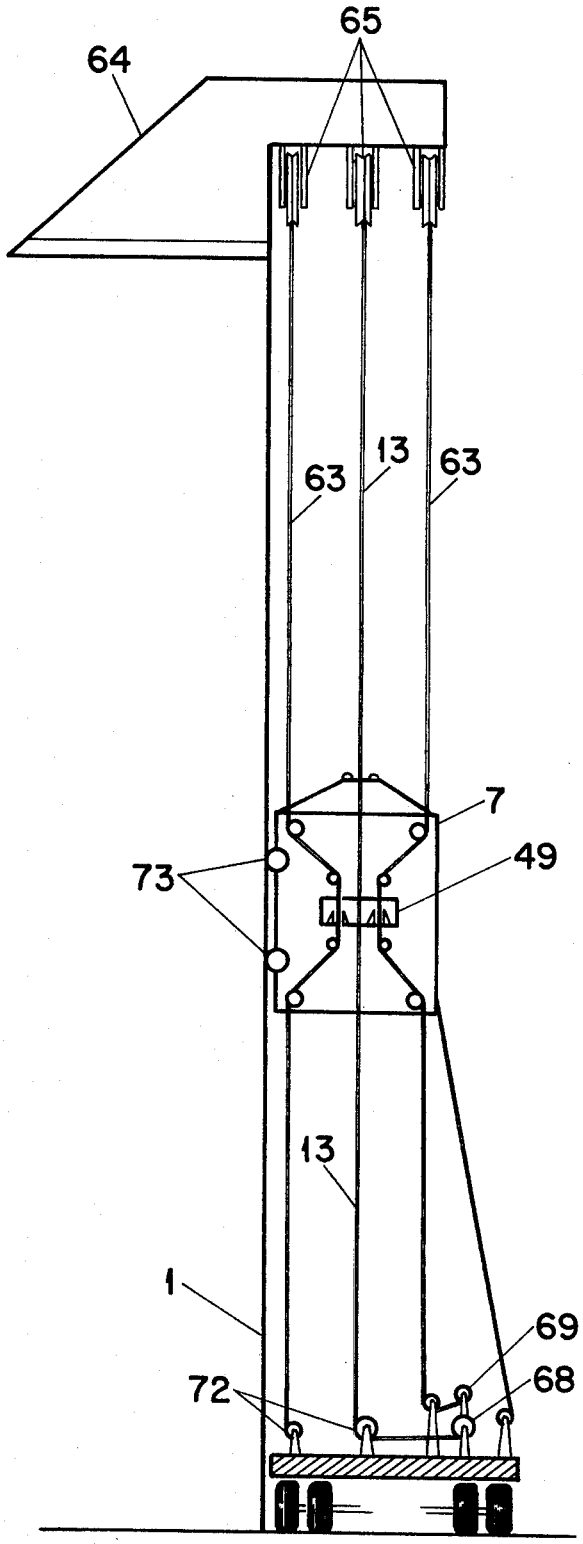
Figure 26:
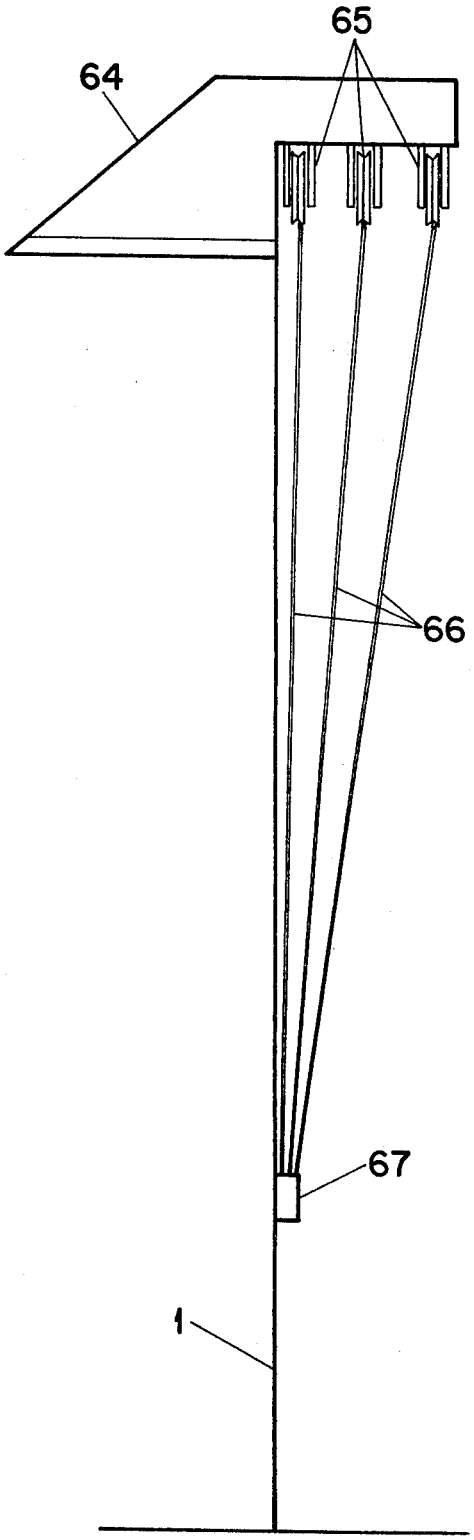
Figure 27:
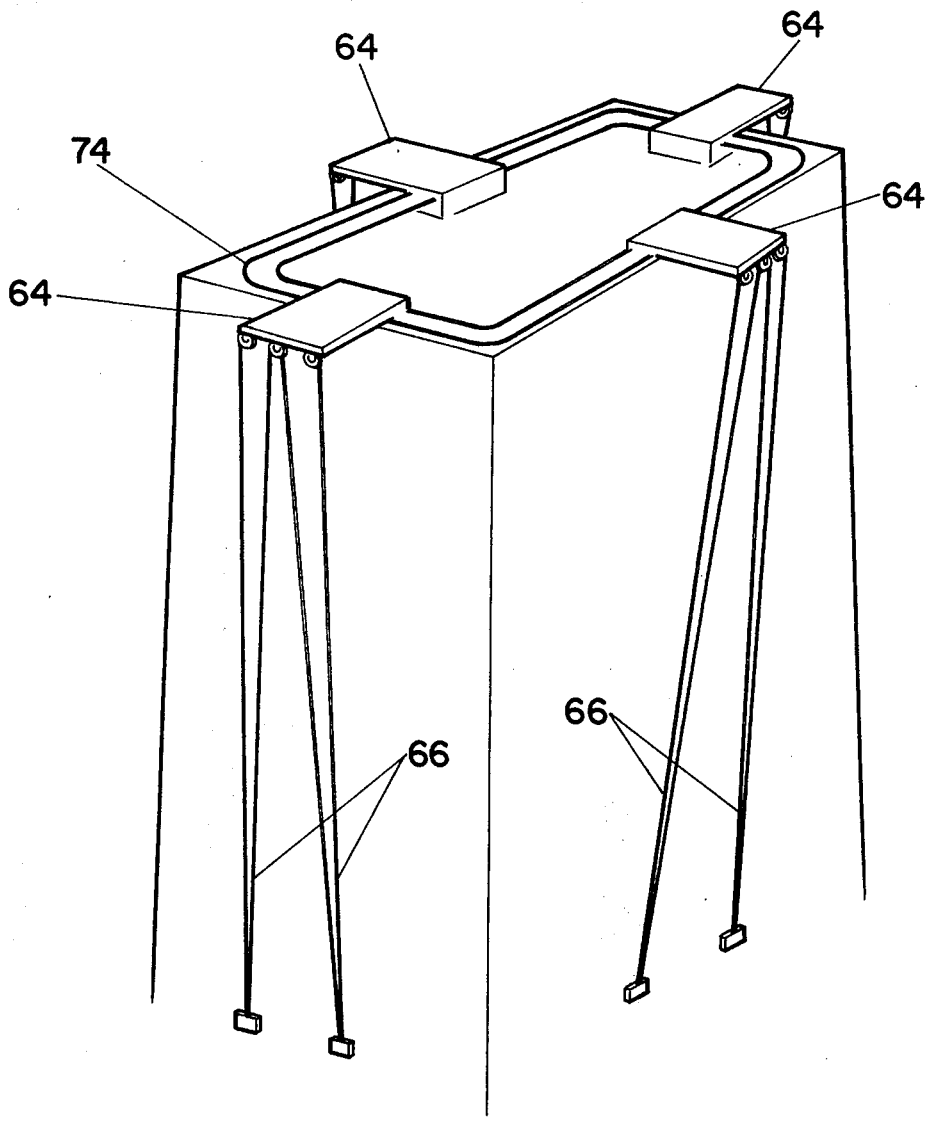
Figure 28:
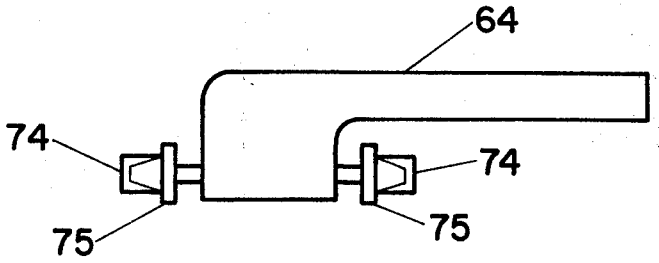

In like fasion the hoist rope system will require two hydraulically driven winches 69. Thus upon engagement of the mobile unit 3 to the vertical railroad 2 in this version of the system the security boxes 67 are opened, the end of each messenger line 66 is coupled to a line from the proper winch, and then the engine driven hydaulic system is operated to reel in the messenger lines and pay out the operating lines. The hoist drums 68 and 69 are shown as being driven by hydraulic motors 70 from the engine driven hydraulic system 71 mounted on the transport unit 20. With hoist drums 68, rail drums 69 and snatch block anchors 72 mounted on the transport unit, the weight of the transport unit 20 is relied upon as anchor for the system. However, dead man anchors as used for power pole guy lines may be used where the weight of the mobile unit components is inadequate. As shown in FIG. 25 two rail lines 63 may be used and paid through overspeed governors and emergency brakes 49 on each side of the railcar 7. Shock mounted guide wheels 73 may be provided on the railcar 7 to ease any contact with the building 1 during raising and lowering. A version of the Emergency Building Access Apparatus using flexible vertical rails 63 may include a fixed rail system 74 on the roof of the building as shown in FIG. 27 with the canitlevered sheave supports 64, secured to the rails 74 by wheels 75 and normally anchored in place for emergency use at a set location. Where access to the roof during emergency is possible and where found desirable, any cantilevered support may be unlocked from its anchor and moved to another location lining up with another set of emergency exit doors 6. The roof top rail system 74 may also be used for like vertical railroad units with flexible rails to support men at various elevations and areas alongside the building for window washing and other maintenance work. The winch motors 70 may be controlled by electrically operated valves 76, a control cable 77 on a rewind reel and control switches 37 in the railcar. Although this is a particularly good application for a hydraulic drive, in some instances mechanical, electrical drives, or combinations might be preferred.

THE TAUT ROPE CLIMBING RAILCAR

A further version of the Emergency Building Access Apparatus is shown in the block diagram of FIG. 29 and the schematic of FIG. 30 in which two taut rope vertical rails 63 are stretched between a pivotable cantilevered top support arm 64 at the top of the building biased by a counterweight 78 and a pivotable bottom anchor arm 84 held down for operation by lock arm 79. When in stored readiness position, the taut rope vertical rails are held against the building by counterweight 78 raising arms 64 and 84 when released from lock arm 79. The traction wheel drive on each side of the railcar 7 is comprised of drive wheels 80 with the taut rope held tightly against them by idler wheels 81 as biased by pneumatic cylinders 82. The drive wheels 80 are driven by electric motor or engine carried by the railcar 7 as controlled from within. Two ropes 63 are used on each side of the railcar 7 for safety should one rope break. Overspeed governor and safety brakes 49 as shown on other versions can be easily accommodated. Guide rollers 83 at top and bottom keep the railcar upright.

THE RIGID RAIL AND CATHEAD

The cantilevered top support 64 with top sheaves 65 of FIGS. 23 through 28 is also termed a cathead 86 and is so designated in FIGS. 31 and 34.

Referring to FIGS. 31, 32, and 33, an embodiment is shown in block diagram and schematics in which the equipment affixed to the building includes rigid rails 4 and 5, cathead 86 made up of cantilevered top support 64 and top sheaves 65, anchors 67 for the temporary hoist messenger ropes 66 shown in phantom in FIG. 33 and emergency exit doors 6. A minimum of capital cost and maintenance is required for the buildings with this embodiment and coupling time requires only reeving the operating hoist line while removing the temporary messenger lines onto drum 85, coupling the operating hoist rope 13 to the railcar 7, and railcar 7 to the rails 4 and 5.

In another version of this embodiment as shown in block diagram FIG. 34 and schematics 35 and 36 the cost and maintenance of the equipment affixed permanently to the building is further reduced resulting in only the two rails 4 and 5 and an anchoring point 16, for the cathead normally at the top of the vertical railroad. FIG. 10 illustrates one example of anchor.

Figure 23:
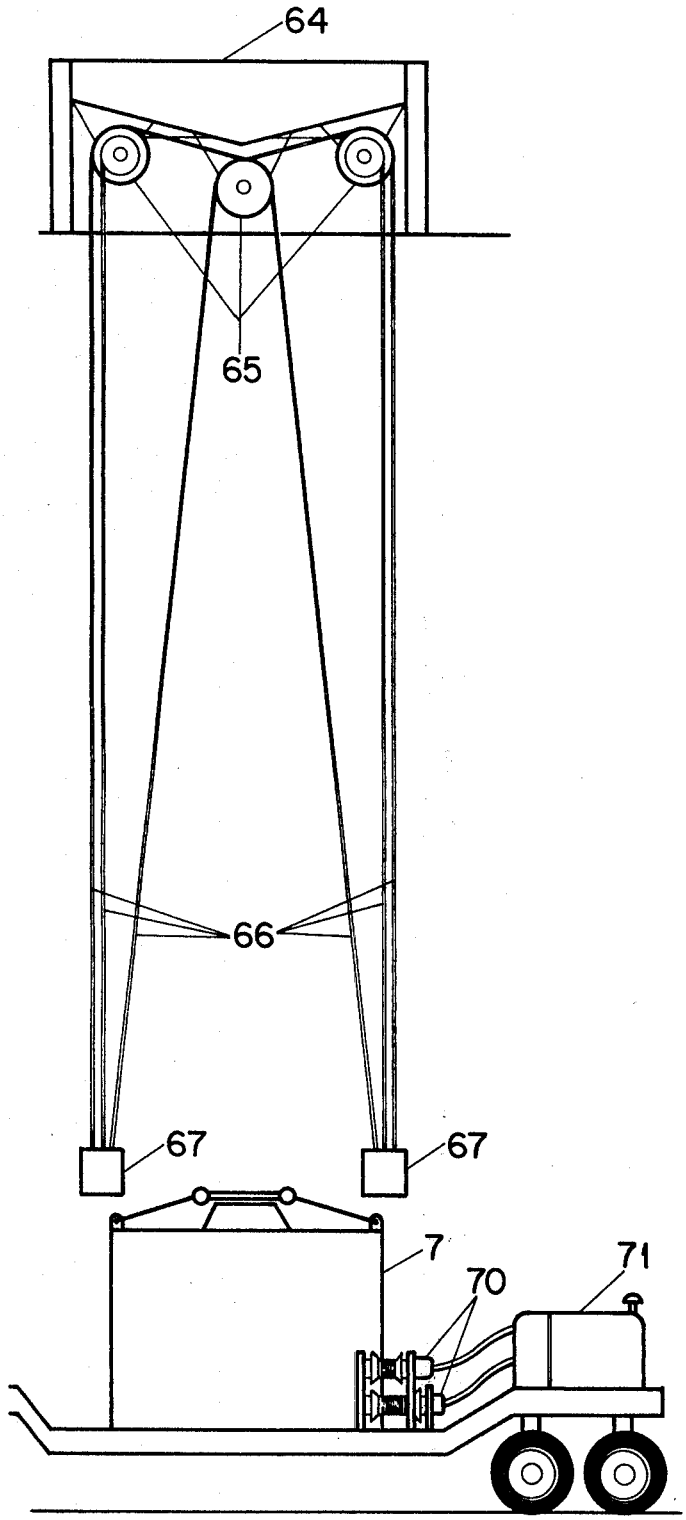
Figure 24:
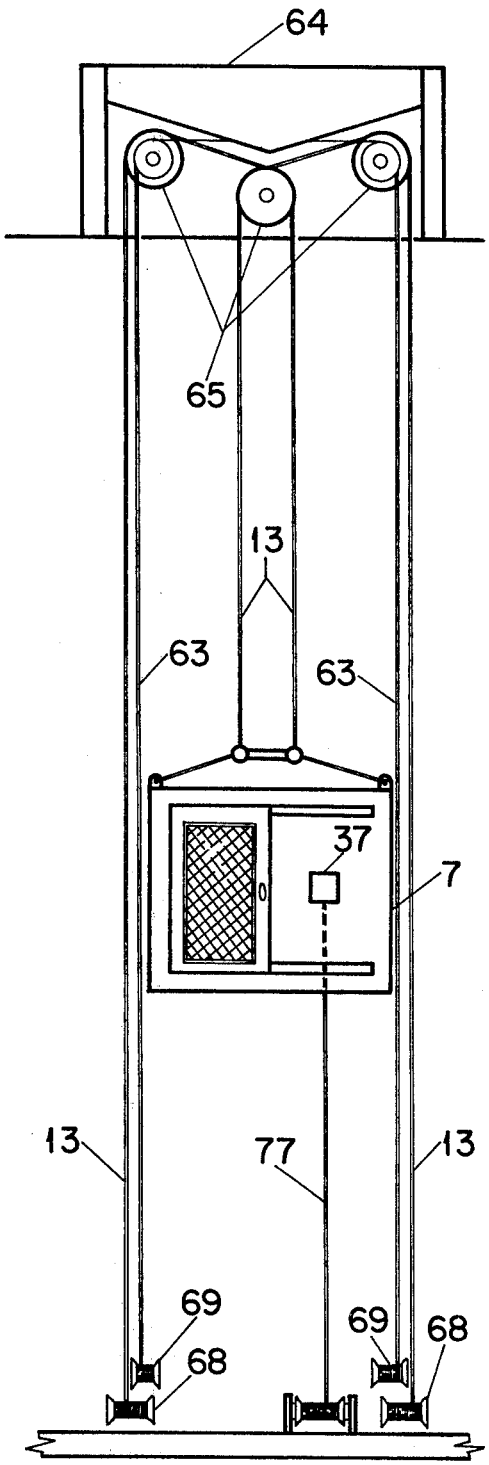
Figure 35:
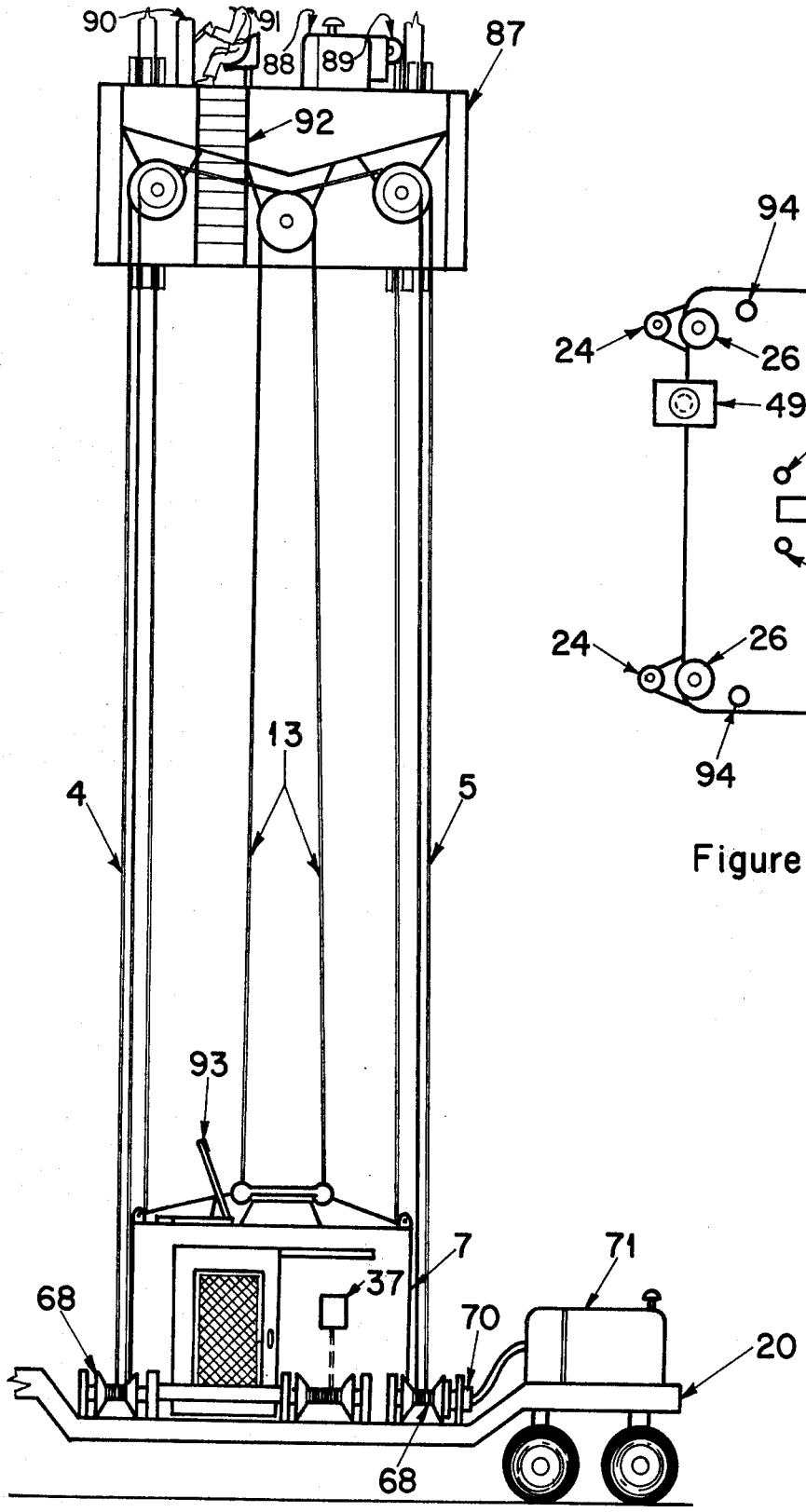
Figure 36:
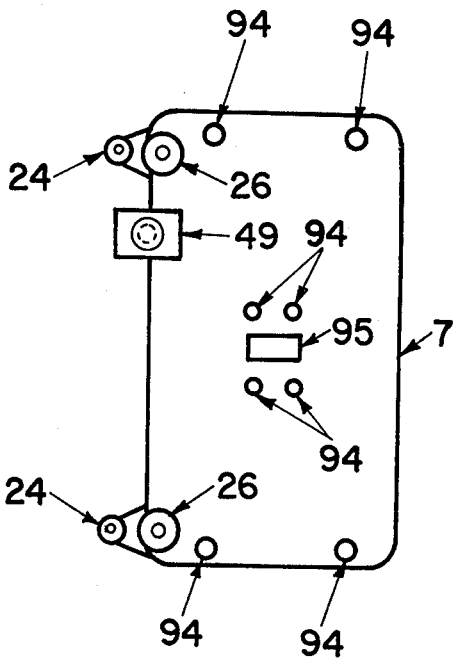

The mobile unit of this version includes a self-powered winch 69 which may be mounted on a truck bed or trailer 20 as shown in FIGS. 23, 24, and 25, a railcar 7, and the climbing cathead 87 as shown in FIGS. 34 and 35. The hoist ropes 13 when stored in readiness on the mobile unit are reeved over the sheaves 65 of the cathead 87 with one end of each secured to the railcar 7 and the other end secured to the winch drums 68. After the mobile unit has been brought up to the vertical railroad and the cathead 87 coupled to the vertical rails 4 and 5, the hoist rope 13 stored on winch drums 68 must be paid out as the cathead 87 ascends. The cathead 87 has its own motive power in the form of an engine 88 driving a traction wheel 89 engaging a drive rack 8 on rail 4 or 5. However, other forms of self-powered climbing devices such as electrically driven traction devices could serve the same purpose. In the version of FIGS. 35 and 36 when the railcar 7 has been coupled to the rails 4 and 5 it may be raised and lowered on the rails by the winches 68 as controlled within the railcar 7.

In the version shown in FIG. 35 the climbing cathead 87 is controlled by an operator 91 using controls 90. When he has driven the cathead 87 to the top of the vertical railroad and anchored it to the building, the operator 91 stops the engine 89 signalling the crew at the base of the building that the cathead is securely anchored. An operator at the base of the building then enters the railcar 7 and using controls 37 raises the railcar to the top of the vertical railroad immediately below the cathead 87. The cathead operator 91 then descends ladder 92 and enters the railcar 93 through access door 93. The railcar 7 is then put into use to provide access to the building.

STANDARDIZATION

Since building owners may have a variety of choices of equipment to be fixed to their buildings in any one area, a railcar 7 as shown in FIG. 36 may very well be needed to accommodate either the taut rope or the rigid rail vertical railroad. Thus, guide wheels 94 and emergency brake unit 95 are for use on taut rope rails 63 as in FIG. 25 and guide wheels 24 and 26 are for use with braking device 49 on rigid rails as in FIGS. 31 through 35. The outer guide wheels 24 serve to guide the railcar 7 on the rails 4 and 5 or when in use with the taut rope rails 63 to guide the railcar 7 along the building wall.

MODE OF OPERATION OF THE INVENTION

In practice, an adequate number of identical, or at least, interchangeable mobile units are stored in a central location such as a fire station near a number of buildings each equipped with a number of standard vertical railroads. The number of such vertical railroads for each building and their placement is preferably determined by the population, type, and density of the buildings. The storage center for the mobile units will be properly furnished with all of the test and maintenance equipment required to assure reliability of the units and manned with well trained operating personnel. The vertical railroads also require periodical testing and maintenance. Fire drills with the mobile units coupled to the vertical railroads should also be required at frequent intervals.

In an emergency, as soon as the alarm has been received at the central station, enough mobile units to serve all vertical railroads of the building on fire will have their engines started and the mobile units then dispatched to the scene with firemen operators where they are quickly coupled to the vertical railroads. If flames and smoke are issuing from the building at a point too close to one or more of the vertical railroads, at the discretion of the fireman operator for that unit it may not be placed into operation until sure of safe operation. Evacuation of the building may then take place at the direction of the fire chief on scene preferably by pre-arranged plan which may mean evacuation of the endangered floor first, followed by the floors above in ascending order since the fire would normally spread upwards. Since the vertical railroad is on the outside of the building and the safe areas can be chosen for operation the railcars will be safely free of smoke. Since the controls for raising, lowering, and stopping the railcar are only on the railcar and the power supply and power transmission are outside the building as a part of the emergency building access apparatus, safety and reliability of the equipment is assured.

I claim:

1. An emergency building access apparatus for evacuating the occupants of the building and to provide access for firemen, which apparatus is self-powered by a portable power plant but dependent structurally upon the building comprising:

a. a vertical railroad comprising:
   1. a vertical rail assembly;
   2. a supporting means attaching the vertical rail assembly to the building in a generally vertical position;
   3. emergency access openings providing access between the building interior and the railroad;

b. a mobile unit operatively connected to the vertical railroad comprising:
   1. a railcar for carrying people;
   2. a means to slidably engage the railcar with the vertical railroad for vertical motion thereon;
   3. a power source comprised of a portable electric generator;
   4. a control means in the railcar to cause the railcar to rise, lower, and stop on the vertical railroad;
   5. a coupling means to join the mobile unit to the vertical railroad; and c. a railcar position control means comprising:
   1. a drive means operably connected to the railcar to raise, lower, or stop the railcar on the vertical railroad comprising:
      a. a rail climbing hoist structure;
      b. a means attaching the rail climbing hoist structure to the vertical railroad in sliding engagement therewith;
      c. an electrically driven traction wheel operably secured to the rail climbing hoist for engagement with the vertical railroad for raising and lowering the rail climbing hoist structure on the vertical railroad;
      d. a power transmission means operatively connecting the portable generator with controls for the electrically driven traction wheel and with controls for an electrically driven hoist;
      e. a control means operatively connected to the electrically driven traction wheel;
      f. an electrically driven hoist operatively secured to the rail climbing hoist structure;
      g. a hoist rope operably connecting the hoist and the railcar such that operation of the hoist will raise, lower, or stop the railcar on the vertical railroad; and
      h. an anchoring device operatively attached to the rail climbing hoist structure to anchor it to the building;
   2. a means operably connecting the drive means with the power source; and
   3. a means operably connecting the railcar control means with the drive means so that operation of the railcar control means will start, stop, or reverse the drive means to raise, lower, or stop the railcar on the vertical railroad comprising:
      a. a control busbar system extending for substantially the length of the vertical rail system;
      b. insulated supporting means attaching the control busbar system to the vertical rail system;
      c. a first set of contact brushes operably connecting the electrically driven hoist with the control busbar system;
      d. insulated supporting means attaching the first set of contact brushes to the hoist structure for operative engagement with the control busbar system;
      e. a second set of contact brushes operably connecting the control busbar system with the control means in the railcar; and
      f. insulated supporting means attaching the second set of contact brushes to the railcar for operative engagement with the control busbar system.

2. An emergency building access apparatus for evacuating the occupants of the building and to provide access for firemen, which apparatus is self-powered by a portable power plant but dependent structurally upon the building comprising:

a. a vertical railroad comprising:
   1. a vertical rail assembly;
   2. a supporting means attaching the vertical rail assembly to the building in a generally vertical position;
   3. emergency access openings providing access between the building interior and the railroad;

b. a mobile unit operatively connected to the vertical railroad comprising:
   1. a railcar for carrying people;
   2. a means to slidably engage the railcar with the vertical railroad for vertical motion thereon;
   3. a power source comprised of a portable generator;
   4. a control means in the railcar to cause the railcar to rise, lower, and stop on the vertical railroad;
   5. a coupling means to join the mobile unit to the vertical railroad; and c. a railcar position control means comprising:
   1. a drive means operably connected to the railcar to raise, lower, or stop the railcar on the vertical railroad comprising:
      a. a rail climbing hoist structure;
      b. a means attaching the rail climbing hoist structure to the vertical railroad in sliding engagement therewith;
      c. an electrically driven traction wheel operably secured to the rail climbing hoist for engagement with the vertical railroad for raising and lowering the rail climbing hoist structure on the vertical railroad;
      d. a power transmission means operatively connecting the portable generator with controls for the electrically driven traction wheel and with controls for an electrically driven hoist;
      e. a control means operatively connected to the electrically driven traction wheel to start, stop, and reverse the traction wheel comprising:
         1. a climbing control busbar system extending for substantially the length of the vertical rail assembly;
         2. insulated supporting means attaching the climbing control busbar system to the vertical rail assembly;
         3. a control switching apparatus at street level operatively connected to the climbing control busbars;
         4. a set of contact brushes operably connecting the climbing control busbar system with the control means for the traction wheel so that operation of the control switching apparatus at street level will cause the traction wheel to start, stop, or reverse thus causing the raising, lowering, or stopping of the climbing hoist structure on the vertical rail assembly; and 5. insulated support means attaching the set of contact brushes to the rail climbing hoist structure for operative engagement with the control busbar system;

f. an electrically driven hoist operatively secured to the rail climbing hoist structure;

g. a hoist rope operably connecting the hoist and the railcar such that operation of the hoist will raise, lower, or stop the railcar on the vertical railroad; and h. an anchoring device operatively attached to the rail climbing hoist structure to anchor it to the building;

2. a means operably connecting the drive means with the power source; and 3. a means operably connecting the railcar control means with the drive means so that operation of the railcar control means will start, stop, or reverse the drive means to raise, lower, or stop the railcar on the vertical railroad.

3. An emergency building access apparatus for evacuating the occupants of the building and to provide access for firemen, which apparatus is self-powered by a portable power plant but dependent structurally upon the building comprising:

a. a vertical railroad comprising:

1. a vertical rail assembly;

2. a supporting means attaching the vertical rail assembly to the building in a generally vertical position;

3. emergency access openings providing access between the building interior and the railroad;

b. a mobile unit operatively connected to the vertical railroad comprising:

1. a railcar for carrying people;

2. a means to slidably engage the railcar with the vertical railroad for vertical motion thereon;

3. a power source comprised of a portable electric generator;

4. a control means in the railcar to cause the railcar to rise, lower, and stop on the vertical railroad;

5. a coupling means to join the mobile unit to the vertical railroad; and c. a railcar position control means comprising:

1. a drive means operably connected to the railcar to raise, lower, or stop the railcar on the vertical railroad comprising:

a. a rail climbing hoist structure;

b. a means attaching the rail climbing hoist structure to the vertical railroad in sliding engagement therewith;

c. an electrically driven traction wheel operably secured to the rail climbing hoist for engagement with the vertical railroad for raising and lowering the rail climbing hoist structure on the vertical railroad;

d. a power transmission means operatively connecting the portable generator with controls for the electrically driven traction wheel and with controls for an electrically driven hoist comprising:

1. a power inlet fitting at street level operatively connected to the portable generator;

2. a power busbar system extending for substantially the length of the vertical rail assembly and operatively connected to the power inlet fitting;

3. insulated supporting means attaching the power busbar system to the vertical rail assembly;

4. a set of contact brushes operably connecting the power busbar system to the controls for the electrically driven hoist; and 5. insulated supporting means attaching the contact brushes to the rail climbing hoist structure for operative engagement with the power busbar system;

e. a control means operatively connected to the electrically driven traction wheel;

f. an electrically driven hoist operatively secured to the rail climbing hoist structure;

g. a hoist rope operably connecting the hoist and the railcar such that operation of the hoist will raise, lower, or stop the railcar on the vertical railroad; and h. an anchoring device operatively attached to the rail climbing hoist structure to anchor it to the building;

2. means operably connecting the drive means with the power source; and 3. a means operably connecting the railcar control means with the drive means so that operation of the railcar control means will start, stop, or reverse the drive means to raise, lower, or stop the railcar on the vertical railroad.

4. An emergency building access apparatus for evacuating the occupants of the building and to provide access for firemen, which apparatus is self-powered by a portable power plant but dependent structurally upon the building comprising:

a. a vertical railroad comprising:

1. a vertical rail assembly;

2. a supporting means attaching the vertical rail assembly to the building in a generally vertical position;

3. emergency access openings providing access between the building interior and the railroad;

b. a mobile unit operatively connected to the vertical railroad comprising:

1. a railcar for carrying people;

2. an access opening in a wall or ceiling of the railcar;

3. a means to slidably engage the railcar with the vertical railroad for vertical motion thereon;

4. a power source comprised of a portable electric generator;

5. a control means in the railcar to cause the railcar to rise, lower, and stop on the vertical railroad;

6. a coupling means to join the mobile unit to the vertical railroad; and c. a railcar position control means comprising;

1. a drive means operably connected to the railcar to raise, lower, or stop the railcar on the vertical railroad comprising:

a. a rail climbing hoist structure;

b. a means attaching the rail climbing hoist structure to the vertical railroad in sliding engagement therewith;

c. an electrically driven traction wheel operably secured to the rail climbing hoist for engagement with the vertical railroad for raising and lowering the rail climbing hoist structure on the vertical railroad;
d. a power transmission means operatively connecting the portable generator with controls for the electrically driven traction wheel and with controls for an electrically driven hoist;
e. a control means operatively connected to the electrically driven traction wheel and operatively attached to the climbing hoist structure in cooperative arrangement with the access opening in the railcar so that an operator within the railcar can use the controls to raise, lower, or stop the rail climbing hoist structure and railcar as a unit;
f. an electrically driven hoist operatively secured to the rail climbing hoist structure;
g. a hoist rope operably connecting the hoist and the railcar such that operation of the hoist will raise, lower, or stop the railcar on the vertical railroad; and
h. an anchoring device operatively attached to the rail climbing hoist structure to anchor it to the building;

2. a means operably connecting the drive means with the power source; and
3. a means operably connecting the railcar control means with the drive means so that operation of the railcar control means will start, stop, or reverse the drive means to raise, lower, or stop the railcar on the vertical railroad.

5. An emergency building access apparatus for evacuating the occupants of the building and to provide access for firemen, which apparatus is self-powered by a portable power plant but dependent structurally upon the building comprising:

a. a vertical railroad comprising;
1. a vertical rail assembly;
2. a supporting means attaching the vertical rail assembly to the building in a generally vertical position;
3. emergency access openings providing access between the building interior and the railroad;

b. a mobile unit operatively connected to the vertical railroad comprising:
1. a railcar for carrying people;
2. a means to slidably engage the railcar with the vertical railroad for vertical motion thereon;
3. a power source;
4. a control means in the railcar to cause the railcar to rise, lower, and stop on the vertical railroad;
5. a coupling means to join the mobile unit to the vertical railroad; and c. a railcar position control means comprising:
1. an electrically driven hoist;
2. supporting means attaching the hoist to the building for an operative relationship with the vertical rail assembly;
3. a hoist rope depending from the hoist and operatively connected therewith;
4. an electrical power inlet fitting at the base of the building;
5. hoist control means operatively connected to the electrically driven hoist for causing the hoist to start, stop, and reverse;
6. a power transmission means operatively connecting the power inlet fitting with the electrically driven hoist assembly through the hoist control;
7. a means to operatively connect the power source with the electrical power inlet fitting to provide electrical power to the hoist;
8. a means to operatively connect the railcar to hoist rope so that operation of the hoist will raise, lower, or stop the railcar on the vertical rail assembly; and
9. a means to operatively connect the control means in the railcar with the hoist control means.

6. An emergency building access apparatus as claimed in claim 5 wherein the means to operatively connect the control means in the railcar with the hoist control means comprises a control busbar means operatively connected to the hoist control means and extending for substantially the length of the vertical rail assembly; insulated supporting means attaching the control busbar means to the vertical rail assembly, a set of contact brushes operatively connected to the control means in the railcar, and insulated supporting means attaching the set of contact brushes to the railcar for operative engagement with the control busbar means.

7. An emergency building access apparatus for evacuating the occupants of the building and to provide access for firemen, which apparatus is self-powered by a portable power plant but dependent structurally upon the building comprising:

a. a vertical railroad comprising:
1. a vertical rail assembly;
2. a supporting means attaching the vertical rail assembly to the building in a generally vertical position;
3. emergency access openings providing access between the building interior and railroad;

b. a mobile unit operatively connected to the vertical railroad comprising:
1. a railcar for carrying people;
2. a means to slidably engage the railcar with the vertical railroad for vertical motion thereon;
3. a power source;
4. a control means in the railcar to cause the railcar to rise, lower, and stop on the vertical railroad;
5. a coupling means to join the mobile unit to the vertical railroad; and c. a railcar position control means comprising:
1. a mechanically driven hoist;
2. supporting means attaching the hoist to the building for an operative relationship with the vertical rail assembly;
3. a hoist rope depending from the hoist and operatively connected thereto;
4. a means to operatively connect the railcar to the hoist rope so that operation of the hoist will raise, lower, or stop the railcar on the vertical railroad;
5. a mechanical power inlet fitting operatively connected to the hoist;
6. a means to operatively connect the power source to the mechanical power inlet fitting for operation of the hoist by the power source;
7. an electrical hoist control means operatively connected to the mechanically driven hoist for causing the hoist to start, stop, and reverse; and
8. a means to operatively connect the control means in the railcar with the hoist control means.

8. An emergency building access apparatus for evacuating the occupants of the building and to provide access for firemen, which apparatus is self-powered by a portable power plant but dependent structurally upon the building comprising:

a. a vertical railroad comprising:
1. a vertical rail assembly;
2. a supporting means attaching the vertical rail assembly to the building in a generally vertical position;
3. emergency access openings providing access between the building interior and the railroad;
4. a cantilevered top sheave structure;
5. a support means operatively attaching the cantilevered top sheave support structure to the building;
6. sheave means operatively connected to the cantilevered top sheave support structure;
7. a temporary messenger line running over the sheave means and operatively anchored to the building near its base; and b. a mobile unit operatively connected to the vertical railroad comprising:
1. a railcar for carrying people;
2. a means to slidably engage the railcar with the vertical rail assembly for vertical motion thereon;
3. a control means in the railcar to cause the railcar to rise, lower, and stop on the vertical rail assembly;
4. a portable engine as a power source;
5. a first hoist winch drum;
6. a control means operatively connecting the first hoist winch drum to the engine so that the engine may drive the drum in either direction or cause it to stop;
7. a second hoist winch drum;
8. a control means operatively connecting the second hoist winch drum to the engine so that the engine may drive the drum in either direction or cause it to stop;
9. an operating hoist line rope carried in reeled storage on the first winch drum;
10. a means attaching a first end of the hoist messenger line to the operating hoist line after the first end of the messenger line has been released from its anchor upon coupling the mobile unit to the vertical railroad;
11. a means attaching the second end of the messenger line to the second winch after the second end of the messenger line has been released from its anchor so that upon coupling the mobile unit to the vertical railroad, the messenger line can be reeled onto the second winch, the end of the operating hoist line drawn over the sheave means, released from the messenger line, and attached to the railcar; and
12. a means to operatively connect the control means in the railcar with the control means for the first winch so that operation of the control means in the railcar can cause the first winch drum to drive in either direction or stop.

9. An emergency building access apparatus for evacuating the occupants of the building and to provide access for firemen, which apparatus is self-powered by a portable power plant but dependent structurally upon the building comprising:

a. a vertical railroad comprising:
1. a vertical rail assembly;
2. a supporting means attaching the vertical rail assembly to the building in a generally vertical position;
3. emergency access openings providing acces between the building interior and the railroad;

b. a mobile unit operatively connected to the vertical railroad comprising:
1. a railcar for carrying people;
2. a means to slidably engage the railcar with the vertical railroad for vertical motion thereon;
3. a power source comprised of a portable electric generator;
4. a control means in the railcar to cause the railcar to rise, lower, and stop on the vertical railroad;
5. a coupling means to join the mobile unit to the vertical railroad; and c. a railcar position control means comprising:
1. a drive means operably connected to the railcar to raise, lower, or stop the railcar on the vertical railroad comprising:
a. a rail climbing hoist structure;
b. a means attaching the rail climbing hoist structure to the vertical railroad in sliding engagement therewith;
c. an electrically driven traction heel operably secured to the rail climbing hoist for engagement with the vertical railroad for raising and lowering the rail climbing hoist structure on the vertical railroad;
d. a power transmission means operatively connecting the portable generator with controls for the electrically driven traction wheel and with controls for an electrically driven hoist;
e. a control means operatively connected to the electrically driven traction wheel;
f. an electrically driven hoist operatively secured to the rail climbing hoist structure;
g. a hoist rope operably connecting the hoist and the railcar such that operation of the hoist will raise; lower, or stop the railcar on the vertical railroad; and
h. an anchoring device operatively attached to the rail climbing hoist structure to anchor it to the building;
2. a means operably connecting the railcar control means with the drive means so that operation of the railcar control means will stop, start, or reverse the drive means to stop, raise, or lower the railcar on the vertical railroad.

10. An emergency building access apparatus for evacuating the occupants of the building and to provide access for firemen, which apparatus is self-powered by a portable power plant but dependent structurally upon the building comprising:

a. a vertical railroad comprising:
1. a cantilevered top sheave support structure;
2. a support means operatively attaching the cantilevered top sheave structure to the building;
3. a first sheave means operatively connected to the cantilevered top sheave support structure;
4. a temporary rail messenger line running over the first sheave means with each end anchored near the base of the building;
5. a second sheave means operatively connected to the cantilevered top sheave support structure;
6. a hoist rope means running over the second sheave means with each end of the hoist rope means temporarily anchored near the base of the building;

7. emergency access openings providing access between the building interior and the railroad;

b. a mobile unit operatively connected to the vertical railroad comprising:

1. a portable engine as a power source;
2. a first hoist winch drum;
3. a control means operatively connecting the first hoist winch drum to the engine so that the engine may drive the drum in either direction or cause it to stop;
4. a second hoist winch drum;
5. a control means operatively connecting the second hoist winch drum to the engine so that the engine may drive the drum in either direction or cause it to stop;
6. an operating rail rope carried in reeled storage on the first winch drum;
7. a means attaching a first end of the temporary rail messenger line to the operating rail line after the first end of the rail messenger line has been released from its anchor upon coupling the mobile unit to the vertical railroad;
8. a railcar for carrying people;
9. a means to slidably engage the railcar with the operating rail line after the second end of the messenger line has been released from its anchor, secured to the second winch drum, the operating line drawn over the first sheave means and anchored at each end;
10. a third hoist winch drum;
11. a control means operatively connecting the third hoist winch drum to the engine so that the engine may drive the drum in either direction or cause it to stop;
12. a control means in the railcar to cause the railcar to rise, lower, and stop on the vertical railroad;
13. means operatively connecting a first end of the hoist rope to the railcar after disconnecting the hoist rope from the anchor;
14. means operatively connecting the other end of the hoist rope to the third hoist winch drum so that operation of that winch can raise, lower, or stop the railcar on the vertical railroad; and
15. means connecting the controls for the third winch drum to the control means in the railcar.

11. An emergency building access apparatus for evacuating the occupants of the building and to provide access for firemen, which apparatus is self-powered by a portable power plant but dependent structurally upon the building comprising:

a. a vertical railroad comprising:

1. a vertical rail assembly;
2. a supporting means attaching the vertical rail assembly to the building in a generally vertical position;
3. emergency access openings providing access between the building interior and the railroad;

b. a mobile unit operatively connected to the vertical railroad comprising:

1. a cantilevered top sheave support structure;
2. a means to slidably engage the cantilevered top sheave structure with the vertical rail assembly for vertical motion thereon;
3. a rail climbing means operatively connected to the cantilevered top sheave structure to case the cantilevered top sheave structure to rise on the vertical rail assembly;
4. a means to anchor the cantilevered top sheave structure to the building;
5. a railcar for carrying people;
6. a means to slidably engage the railcar with the vertical railroad for vertical motion thereon;
7. a control means in the railcar to cuase the railcar to rise, lower, and stop on the vertical railroad;
8. sheave means operatively connected to the cantilevered top sheave support structure;
9. a hoist rope means running over the sheave means;
10. means connecting one end of the hoist rope means to the railcar;
11. a portable engine as a power source;
12. a hoist winch;
13. an anchoring means operatively connected to the winch;
14. winch control means operatively connecting the winch to the engine;
15. means operatively connecting the hoist rope means to the winch; and
16. means connecting the control means in the railcar to the winch control means.

12. An emergency building access apparatus as claimed in claim 1 in which the rail climbing means comprises:

a. a power source;
b. a traction drive means;
c. a support means attaching the traction drive means to the cantilevered top sheave structure in operative engagement with the vertical rail assembly;
d. a power transmission means operatively connecting the power source with the traction drive means; and
e. a control means operatively connected to the rail climbing means such that operation of the rail climbing means may be selected to raise, lower, or stop the cantilevered top sheave structure on the vertical railroad.

13. An emergency building access apparatus as in claim 12 in which the power source is an engine operatively attached to the cantilevered top sheave structure.

14. An emergency building access apparatus as claimed in claim 12 in which the power source for the rail climbing means is an electric motor operatively connected to an engine driven generator also comprising the engine driven generator.

15. A railcar for use with emergency building access apparatus comprising:

a. a structure for carrying people;
b. a control means operatively connected to the structure to cause the railcar to rise, lower, and stop on a vertical railroad;
c. a first set of guide rollers operably connected to the railcar and fitted to engage a rigid rail means; and
d. a second set of guide rollers operably connected to the railcar and fitted to engage a taut rope rail means whereby the railcar may be readily adapted to either type of rail.

* * * * *